US006216512B1

(12) United States Patent
Irie

(10) Patent No.: US 6,216,512 B1
(45) Date of Patent: Apr. 17, 2001

(54) METHOD AND APPARATUS FOR FORMING A PROCESSED PORTION OF A WORKPIECE

(75) Inventor: Tohru Irie, Nagoya (JP)

(73) Assignee: Sango Co., Ltd., Nagoya (JP)

( * ) Notice: Subject to any disclaimer, the term of this patent is extended or adjusted under 35 U.S.C. 154(b) by 0 days.

(21) Appl. No.: 09/502,232

(22) Filed: Feb. 11, 2000

Related U.S. Application Data

(63) Continuation-in-part of application No. 09/192,403, filed on Nov. 16, 1993, now Pat. No. 6,067,833.

(30) Foreign Application Priority Data

Nov. 18, 1997 (JP) ..... 9-317154

(51) Int. Cl.[7] ..... B21D 3/02

(52) U.S. Cl. ..... 72/121; 72/82; 72/94; 72/120

(58) Field of Search ..... 72/82, 83, 84, 72/94, 101, 120, 121; 29/890, 890.8

(56) References Cited

U.S. PATENT DOCUMENTS

| | | | | |
|---|---|---|---|---|
| 1,500,261 | | 7/1924 | Page . | |
| 3,340,713 | | 9/1967 | Webb . | |
| 3,477,264 | * | 11/1969 | Sohlemann | 72/81 |
| 3,533,259 | | 10/1970 | Marcouitch . | |
| 4,061,009 | | 12/1977 | Kaporovich . | |
| 4,143,535 | | 3/1979 | Bouman . | |
| 4,563,887 | | 1/1986 | Bressan et al. . | |
| 5,570,603 | | 11/1996 | Chatterly et al. . | |
| 5,758,532 | | 6/1998 | Massee . | |
| 5,901,595 | | 5/1999 | Massee . | |
| 5,937,516 | * | 8/1999 | De Sousa et al. | 72/84 |
| 5,996,386 | * | 12/1999 | Pazzaglia | 72/84 |

FOREIGN PATENT DOCUMENTS

| | | | | |
|---|---|---|---|---|
| 54-41271 | | 12/1979 | (JP) . | |
| 57-58925 | * | 4/1982 | (JP) | 72/82 |
| 58-202927 | * | 11/1983 | (JP) | 72/83 |
| 3-146232 | | 6/1991 | (JP) . | |
| 3-226327 | | 10/1991 | (JP) . | |
| 2534530 | | 6/1996 | (JP) . | |

OTHER PUBLICATIONS

Mathew, P., "Eccentric Metal Spinning—A New Method to Produce Multi–Recessed Parts", Metallurgia and Metal Forming, Dec. 1974, pp. 378–379.

Sereda, V.G., "Calculation of the Energy and Force Parameters in Planetary Rolling of Tubular Blanks," Kuznechno–shtampovochnoe proizvodstvo, 1989, No. 5, pp. 2–4.

* cited by examiner

*Primary Examiner*—Ed Tolan
(74) *Attorney, Agent, or Firm*—Oliff & Berridge, PLC

(57) ABSTRACT

A method and apparatus for processing a portion of a workpiece. At least one roller is supported on a rotatable member rotatable about a main axis to be radially moved to and from the main axis. The workpiece is supported to position a central axis of the portion to be processed at least one of offset from and oblique to a forming target axis overlapping the main axis. Then, at least one of the workpiece and the roller is driven to be rotated relative to each other about the forming target axis, while the roller is moved radially toward the forming target axis, with the roller being in substantial contact with a surface of the portion to be processed. As a result, the portion to be processed is formed into a changed diameter portion having the forming target axis.

20 Claims, 36 Drawing Sheets

METHOD AND APPARATUS FOR FORMING A PROCESSED PORTION OF A WORKPIECE

This application is a Continuation-in-Part of U.S. application Ser. No. 09/192,403, filed Nov. 16, 1998, now U.S. Pat. No. 6,067,833 which is incorporated herein by reference.

BACKGROUND OF THE INVENTION

1. Field of Invention

The invention relates to a method for forming a portion of a workpiece, such as a cylinder or shell, and an apparatus therefor, especially the method and apparatus for forming the portion of the workpiece by spinning to form a changed diameter portion having a central axis that is at least one of offset from and oblique to a central axis of an unprocessed portion of the workpiece.

2. Description of Related Art

In Japanese Patent Laid-open Publication No. 3-226327, disclosed is a method for forming an end portion of a cylindrical member (hereinafter, simply referred to as a cylinder) made of metal to form a reduced diameter portion on the end portion. According to the Publication, a spinning process is performed by supporting the cylinder with a chuck and rotating it about its axis, and moving a roller for forming toward the axis to reduce the diameter of the cylinder, thereby to form the reduced diameter portion having a neck portion and a tapered portion. In general, the spinning process is employed to form a plate into a shell. Likewise, a flange and neck portion can be formed by spin flow forming into a cylindrical can body, as disclosed in U.S. Pat. No. 4,563,887. Furthermore, a computerized spinning machine has been proposed in Japanese Patent No. 2,534,530.

Recently, it has been requested to form a reduced diameter end portion having an oblique axis inclined against the central axis of the metal cylinder. When the metal cylinder is used for an outer shell of a muffler of an automotive vehicle, for example, the cylinder will be easily mounted in a vehicle. Also, when the metal cylinder is used for a housing of a catalytic converter, it will be easily located near an engine, to reduce the time of increasing the temperature of the catalyst. Furthermore, dual converters may be easily assembled, with their neck portions positioned close to each other.

According to the prior methods for forming the cylinder or shell by the spinning process, the reduced diameter portion was formed to be coaxial with the main body of the cylinder, but the reduced diameter end portion having the oblique axis could not be formed. In order to produce the cylinder like the shell or housing as described above, therefore, the portions corresponding to the main body and the reduced diameter portion were formed by press working, and then these components were connected together by welding or the like. According to these methods, however, the produced cylinder can not be expected to be so strong, comparing with that of the integral construction. Furthermore, they need the connecting process, different from the forming process, so that it is difficult to produce the cylinder by those methods, and it is almost impossible to produce the cylinder by the computerized forming process as described in the prior publication. As a result, the manufacturing cost of the cylinder shall be increased, comparing with the cylinder of the coaxial type formed by the spinning process.

SUMMARY OF THE INVENTION

Accordingly, it is an object of the invention to provide a method for forming a changed diameter portion of a workpiece having a central axis that is at least one of offset from and oblique to a central axis of an unprocessed portion of the workpiece, easily and properly by a spinning process.

It is another object of the invention to provide an apparatus for forming a changed diameter portion having a central axis at least one of offset from and oblique to a central axis of an unprocessed portion of the workpiece, easily and properly by a spinning process.

In accomplishing the above and other objects, the method for forming the changed diameter portion of the workpiece by spinning may comprise supporting the workpiece so that a central axis of the portion to be processed is at least one of offset from and oblique to a forming target axis and molding the portion to be processed by a spinning process so that the central axis of the portion to be processed is matched to the forming target axis and simultaneously changing the diameter of the portion to be processed.

The apparatus for forming the changed diameter portion of the workpiece by spinning may comprise devices for performing the steps as described above. For example, the apparatus may include at least one roller operatively mounted on a rotatable member rotatable about a main axis to be radially movable to and from the main axis, and in contact with a surface of the portion to be processed. In the apparatus, a first driving device may be provided for moving at least one of the workpiece and the at least one roller relative to each other so that a central axis of the portion to be processed is at least one of offset from and oblique to a forming target axis that at least partially overlaps the main axis. A second driving device may be provided for moving the at least one roller radially toward the forming target axis, with the at least one roller being in substantial contact with a surface of the portion to be processed, and rotating the at least one roller about the main main axis relative to the workpiece. A controller controls the first and second driving devices to form the portion to be processed into a changed diameter portion having the forming target axis.

According to the method and apparatus as described above, the changed diameter portion may be formed to provide a tapered portion, with the diameter of the workpiece gradually changed from an unprocessed portion toward an end of the changed diameter portion. The changed diameter portion may be formed to provide the tapered portion and a neck portion of a tubular configuration extending from the tapered portion.

BRIEF DESCRIPTION OF THE DRAWINGS

The above stated objects and following descriptions will become readily apparent with reference to the accompanying drawings, wherein like reference numerals denote like elements, and in which.

DETAILED DESCRIPTION OF PREFERRED EMBODIMENTS

Figure 1:
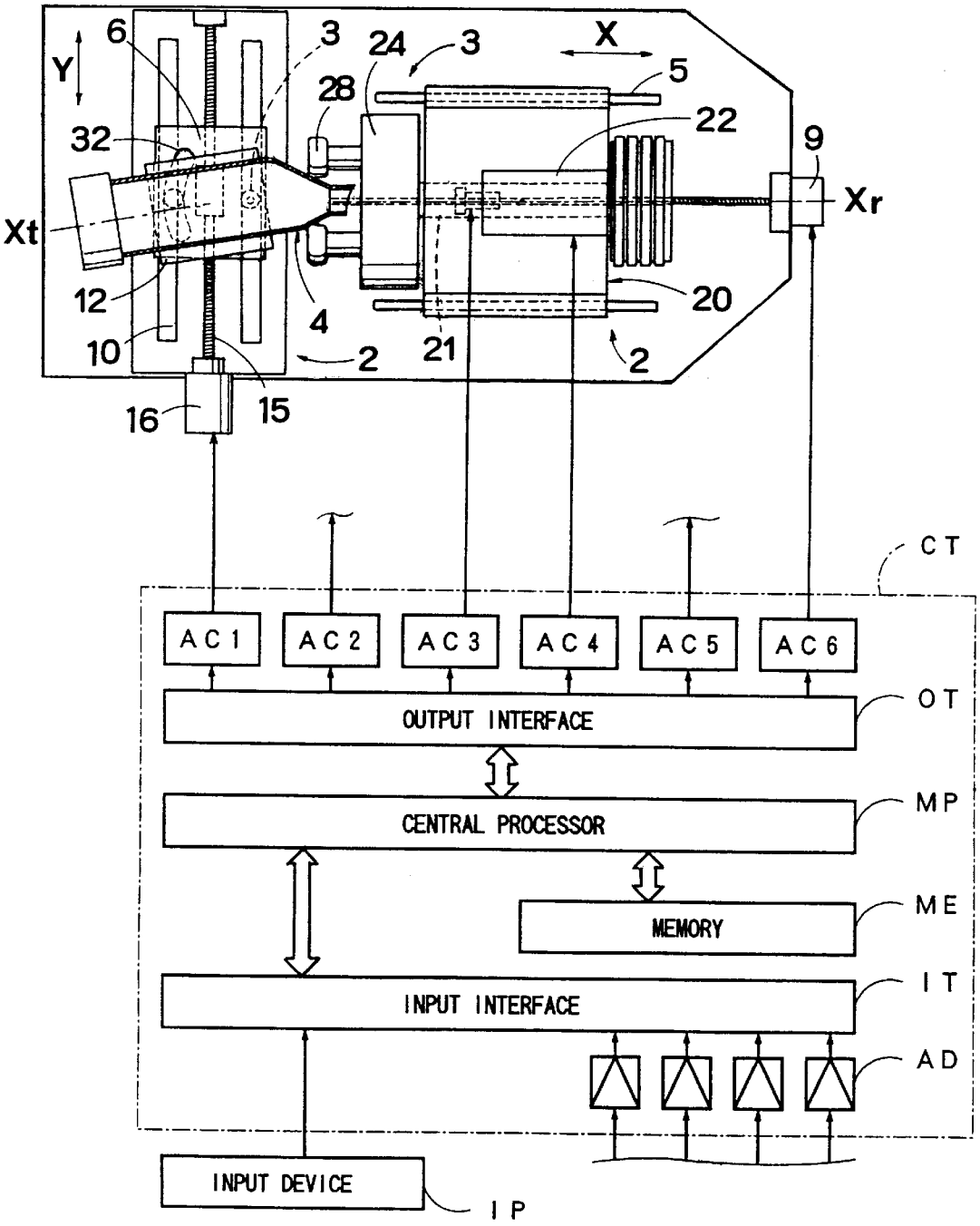
FIG. 1 is a schematic block diagram illustrating a spinning apparatus according to an embodiment of the invention.
Figure 2:
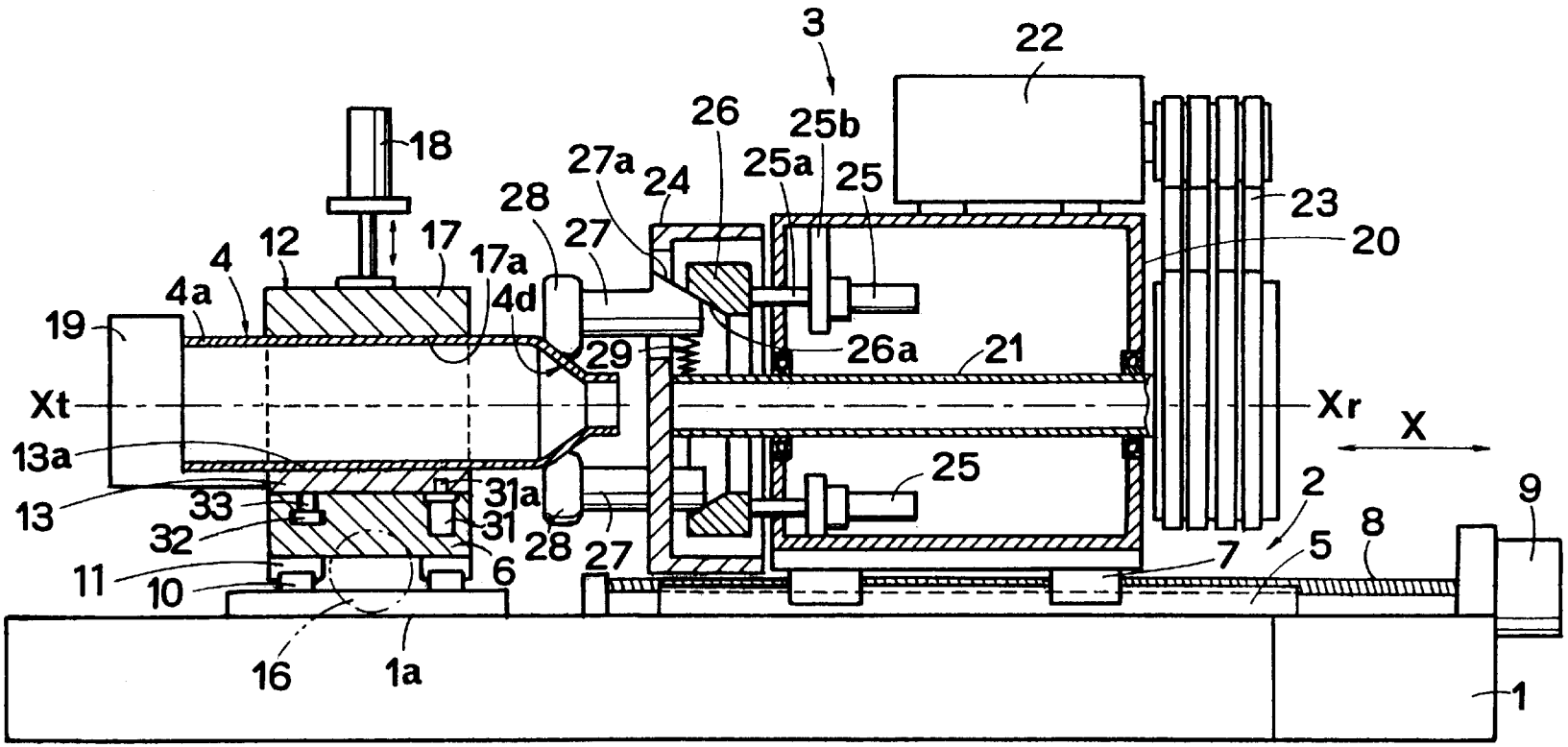
FIG. 2 is a side view of a spinning apparatus with a portion thereof sectioned according to an embodiment of the invention.
Figure 3:
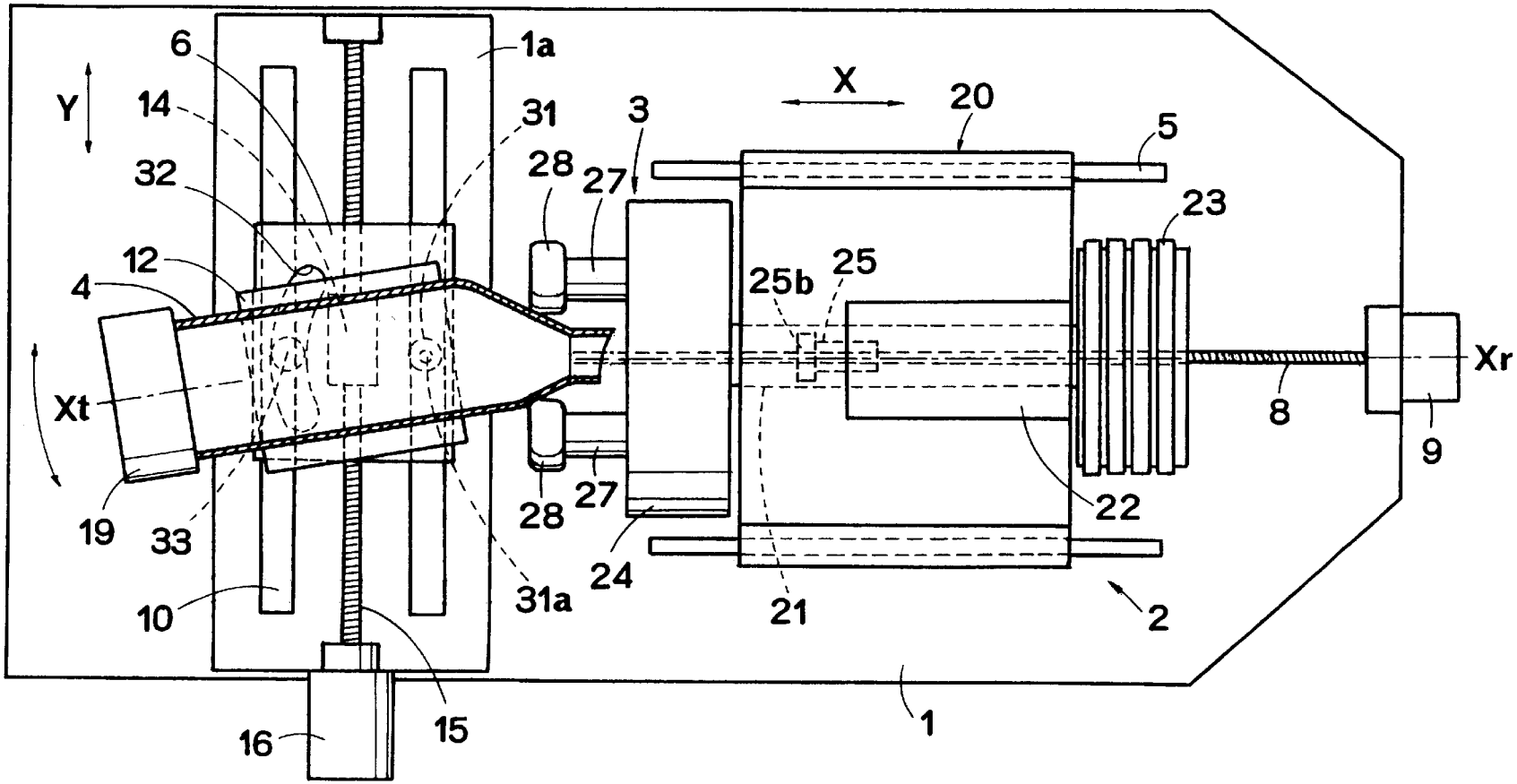
FIG. 3 is a plan view of a spinning apparatus with a portion thereof sectioned according to an embodiment of the invention.
Figure 5:
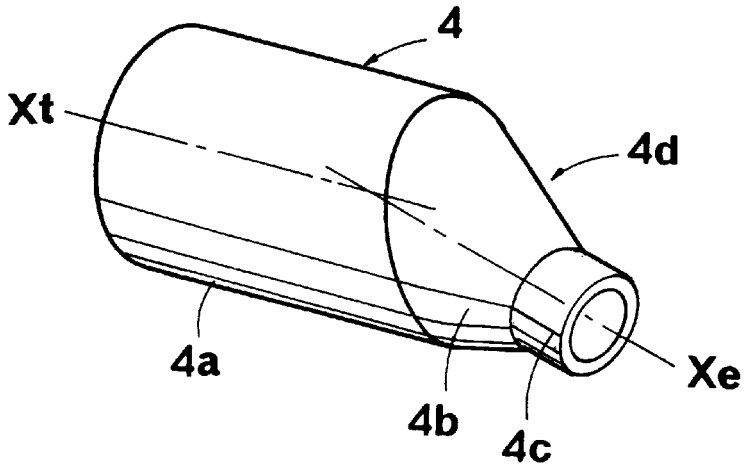
FIG. 5 is a perspective view of a finished cylinder according to an embodiment of the invention.

Referring to FIGS. 1–3, there is schematically illustrated a spinning apparatus according to an embodiment of the invention, which is adapted to configure an end portion of a cylindrical member 4 (i.e., cylinder) having a central axis Xt and an oblique axis Xe inclined against the axis Xt, as shown in FIG. 5, to be used for an outer shell (not shown) of a muffler for an automobile, a case (not shown) of a catalytic converter, or the like. The cylinder to be formed according to the invention is the one made of stainless steel, while it is not limited to this, and may be selected from other metallic cylinders. In FIGS. 1–3, the spinning apparatus according to the invention includes a first driving mechanism 2 and a second driving mechanism 3, both of which are operatively mounted on a base 1.

In the first driving mechanism 2, a central axis Xt of a cylinder 4 is employed as X-axis, in parallel with which a pair of X-axis guide rails 5 are fixedly secured to one side (right side in FIGS. 2 and 3) on the base 1. A case 20 is arranged to be movable along the X-axis guide rails 5. The case 20 has a ball socket 7 secured under its base, which is engaged with a spline shaft 8. This shaft 8 is mounted on the base 1 in parallel with the X-axis guide rails 5, to be rotated by a servo motor 9. Accordingly, when the spline shaft 8 is rotated by the servo motor 9, the case 20 is moved along the X-axis. On the other hand, a bed la is formed on the other side (left side in FIGS. 2 and 3) of the base 1. Fixedly secured to the bed la are a pair of Y-axis guide rails 10, on which a pair of sliders 11 for supporting a sliding table 6 and a clamp device 12 are movably mounted, respectively. The clamp device 12 includes a lower clamp 13 rotatably mounted on the table 6, and an upper clamp 17 arranged upward of the lower clamp 13, to clamp the cylinder 4 between the lower clamp 13 and upper clamp 17. The table 6 has a ball socket 14 secured thereunder, which is engaged with a spline shaft 15. This shaft 15 is mounted on the base 1*a* in parallel with the Y-axis guide rails 10, to be rotated by a servo motor 16. When the spline shaft 15 is rotated by the motor 16, the table 6 and clamp device 12 are moved along the Y-axis relative to the case 20. A rotating device such as a motor 31 is embedded in the table 6, and an output shaft 31 a of the motor 31 extends upward in FIG. 2, or vertically to the base 1, to be engaged with the lower clamp 13, which is rotated about the shaft 31*a*. On the upper surface of the table 6, there is formed a guide groove 32 which has a circular configuration with its center located on the shaft 3 la, and into which a guide roller 33 is fitted. The guide roller 33 is rotatably mounted on the lower clamp 13, so that the lower clamp 13 is guided by the groove 32 to be rotated about the shaft 31*a*.

Above the clamp device 12, an actuator 18, which is activated by oil pressure, for example, and which serves as a driving device, is arranged to support the upper clamp 17 and drive it vertically. When the cylinder 4 is set to or removed from the clamp device 12, the upper clamp 17 is lifted by the actuator 18 upward. A clamp face 13*a* of a half cylinder configuration is formed on the upper surface of the lower clamp 13, and a clamp face 17*a* of a half cylinder configuration is formed on the lower surface of the upper clamp 17. Therefore, when the cylinder 4 is clamped between the clamp faces 13*a* and 17*a*, it is secured not to be rotated or moved. On the clamp device 12, a stopper 19 is disposed at the opposite side to the case 20, to abut on a one end portion of the cylinder 4. The stopper 19 is secured to the lower clamp 13, so as to be movable together with the clamp device 12. If the stopper 19 is connected to the lower clamp 13 to be adjustable along the central axis Xt of the cylinder 4, positioning of the cylinder 4 in its axial direction can be made properly and easily. Accordingly, when the cylinder 4 is set on the clamp face 13*a* of the lower clamp 13, with the one end portion of the cylinder 4 abutted on the stopper 19, and then the upper clamp 17 is actuated to move downward by the actuator 18, the cylinder 4 is clamped at a predetermined position between the lower clamp 13 and upper clamp 17. In this case, the cylinder 4 is positioned such that its axis Xt is located on the same plane as the plane where the longitudinal central axis Xr of a main shaft 21, which will be described later, is located in parallel with the base 1, i.e., on the same height from the base 1 as the height of the axis Xr from the base 1.

With respect to the second driving mechanism 3, the main shaft 21 is positioned on the same plane as the plane, on which the axis Xt of the cylinder 4 is located, and which is parallel with the base 1. The main shaft 21 is placed opposite to the cylinder 4, and mounted on the case 20 to be rotated about its axis Xr by a motor 22, which serves as the rotating device, through a connecting belt 23. A rotary member 24 is secured to one end portion of the main shaft 21 opposite to the cylinder 4, so that the rotary member 24 is rotated about the axis Xr in accordance with the rotation of the main shaft 21 about the axis Xr. The rotary member 24 is formed into a cylindrical case with a bottom, at the center of which the main shaft 21 is secured to the rotary member 24. In the case 20, a pair of actuators 25 of a pressure cylinder actuated by oil, air or the like are received and mounted on the case 20 through brackets 25*b*. Each actuator 25 has a rod 25*a* slidably received therein in parallel with the axis Xr of the main shaft 21, and moved back and forth in response to the pressurized oil or air fed into the actuator 25. A force transmitting member 26 of a circular ring plate configuration is secured to the tip ends of the rods 25*a*, and disposed within the rotary member 24 to be moved to and from the cylinder 4 in response to the sliding movement of the rods 25*a*. The transmitting member 26 has a tapered surface 26*a* formed on the inner surface of its open end portion, extending toward its tip end to enlarge its inner diameter gradually.

Figure 4:
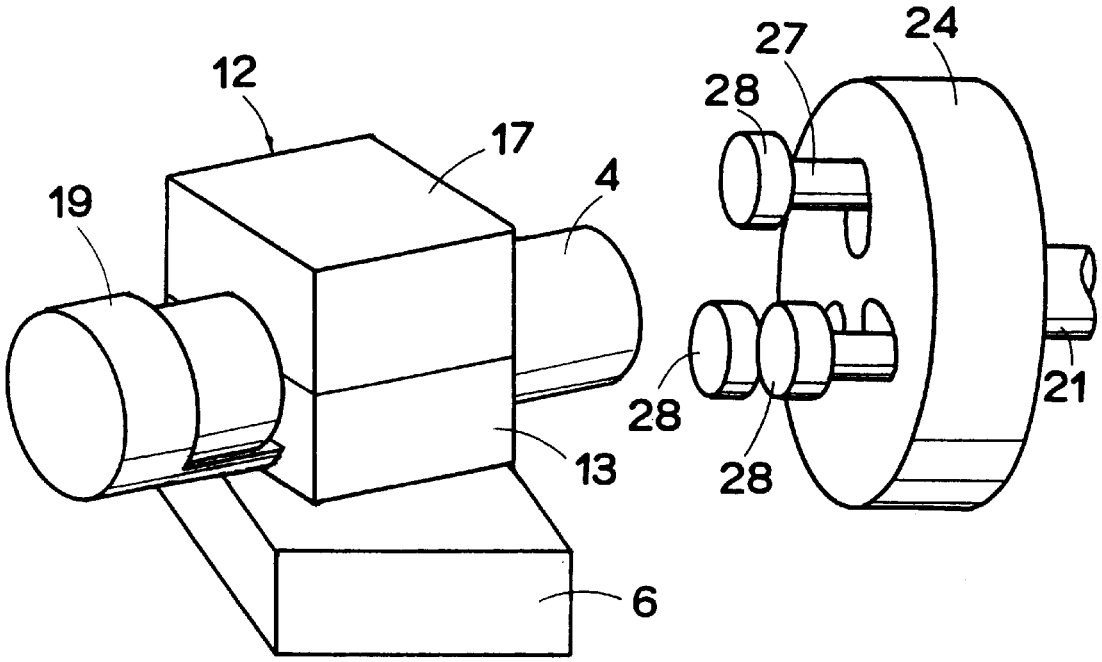
FIG. 4 is a perspective view showing a clamp section according to an embodiment of the invention.

As shown in FIGS. 2 and 4, a plurality of support members 27 (three support members in the present embodiment) are disposed around the periphery of the rotary member 24 with an even space defined between them, and operatively mounted on the rotary member 24 to be movable in parallel with the main shaft 21, and movable in a radial direction to and from the central axis Xr of the main shaft 21. Each support member 27 has a tapered surface 27*a* formed on the inner side of the rotary member 24 to abut on the tapered surface 26*a* of the transmitting member 26. A roller 28 is mounted on the tip end of each support member 27 to be rotated about its axis. Also disposed in the rotary member 24 is a biasing device for urging each support member 27 toward the outer periphery of the rotary member 24, such as a compression spring 29 as shown in FIG. 2. Accordingly, when the transmitting member 26 is activated by the actuators 25 to move forward (leftward in FIG. 2), each support member 27 engaged with the transmitting member 26 through the tapered surfaces 26*a*, 27*a*, and each roller 28 mounted on the support member 27 are moved in a radial direction toward the axis Xr of the main shaft 21. Whereas, when the transmitting member 26 is retracted by the actuators 25 to move rearward (rightward in FIG. 2), each support member 27 and roller 28 are moved outwardly in a radial direction.

Only roller 28 may be provided, but it is preferable to provide a plurality of rollers, so as to reduce intermittent impacts. The course traced by the roller 28 is not necessarily limited to a straight line in the radial direction, but any course may be selected as long as the roller 28 can be moved to and from the axis Xr of the main shaft 21. Instead of the actuator 25 of the pressure cylinder, other devices such as those of a screw type, lever type or the like may be employed as the device for actuating the roller 28. As a further embodiment of the device for actuating the roller 28 to be moved in a radial direction toward the axis Xr, may be employed a mechanism having a main shaft of dual tubes, which are connected to the roller 28 through differential gear units (e.g., planetary gear system, not shown herein), respectively, and wherein the rotation of the main shaft will produce a difference between the rotational speeds of the tubes, so as to cause the roller 28 to be moved in the radial direction.

The motors 9, 16, 22, 31 and actuators 18, 25 are electrically connected to a controller CT as shown in FIG. 1, from which control signals are output to the actuators to control them numerically. The controller CT includes a central processor MP, memory ME, input interface IT and output interface OT, which are connected with each other through a bass bar, as shown in FIG. 1. The central processor MP is adapted to execute a program for spinning according to the present embodiment, and the memory ME is adapted to memorize the program and temporarily memorize variable data needed to execute the program. An input device IP is connected to the input interface IT to input initial conditions, operating conditions or the like of each actuator into the central processor MP, e.g., by operating a key board or the like manually. There are provided various sensors (not shown), if necessary, and signals detected by those sensors are fed to the controller CT, in which the signals are input from the input interface IT to the central processor MP through amplifying circuits AD or the like. The control signals are output from the output interface OT and fed into the motors 9, 16, 22, 31 and actuators 18, 25, through driving circuits AC1 to AC6. Instead of the controller CT, a control circuit may be provided for each device to perform a predetermined individual control, respectively.

Figure 6:
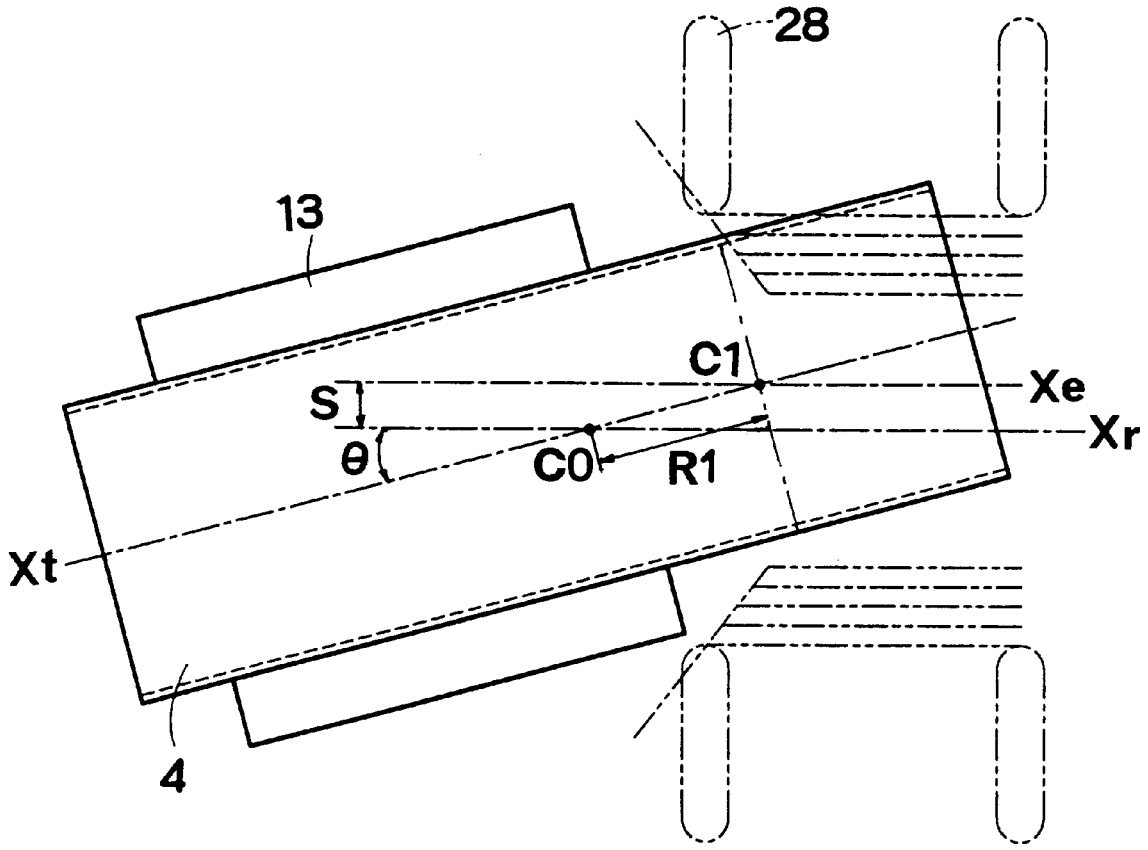
FIG. 6 is a plan view of a cylinder showing a first spinning process applied thereto according to an embodiment of the invention.
Figure 7:
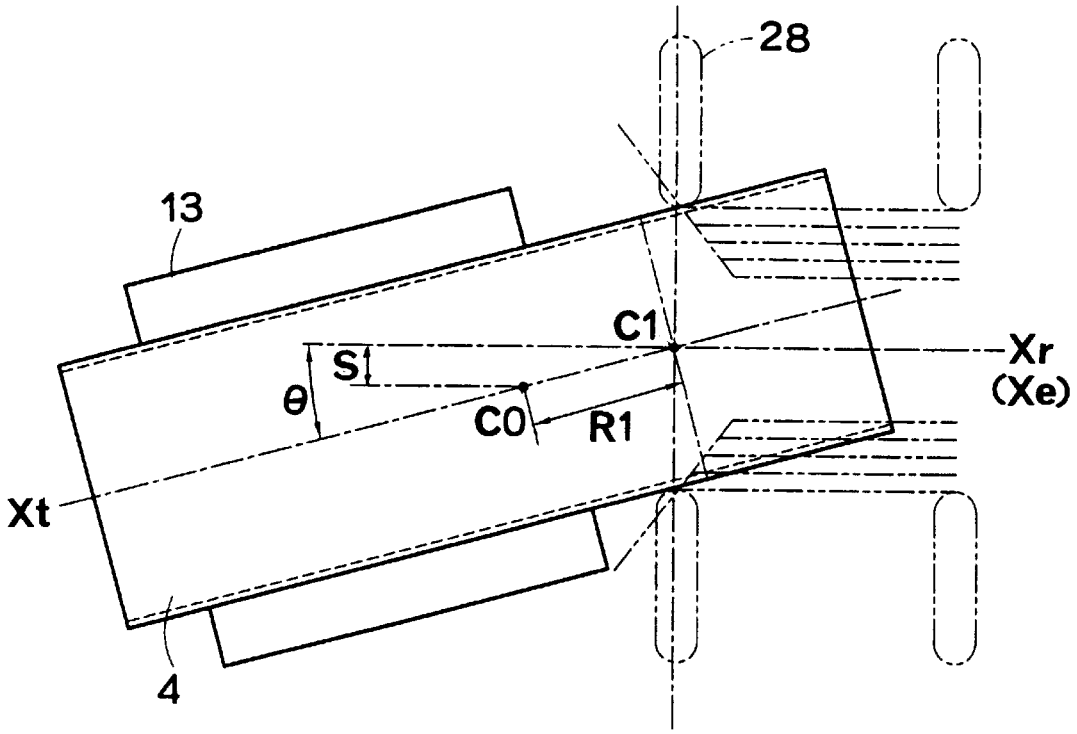
FIG. 7 is a plan view of a cylinder showing a first spinning process applied thereto according to an embodiment of the invention.
Figure 8:
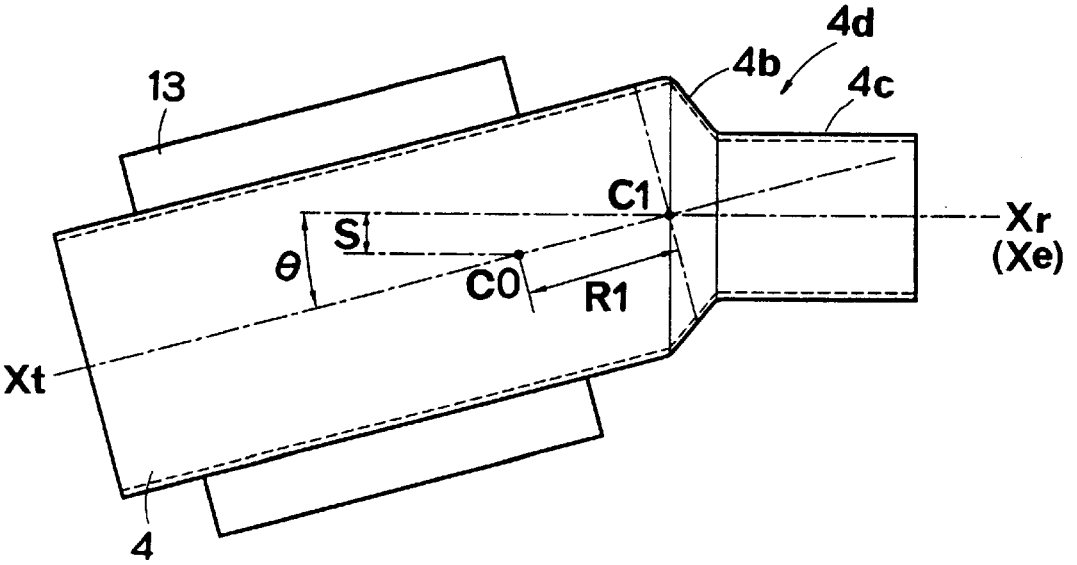
FIG. 8 is a plan view of a cylinder formed by a first spinning process according to an embodiment of the invention.

According to the spinning apparatus as constituted above, various methods can be contemplated for reducing the diameter of the end portion having the oblique axis. Referring to FIGS. 6–8, there will be explained an embodiment of the method for reducing the diameter of the end portion of the cylinder by the above-described spinning apparatus, to form the reduced diameter end portion having the oblique axis, by means of a single rotating process in setting the oblique axis. In FIG. 6, "C0" indicates the center of rotating motion of the cylinder 4 held by the clamp device 12, and rotated about the shaft 31*a* of motor 31. "C1" indicates the center of the innermost end section of the oblique end portion of the cylinder 4 to be formed. "R1" is the distance between the centers C0 and C1.

The axis Xr of the main shaft 21 is fixed on the plane in parallel with the base 1, while the cylinder 4 is rotated about the shaft 31 a, i.e., center C0, to produce an oblique angle θ as shown in FIG. 6. In this case, the oblique axis Xe in parallel with the axis Xr and including the center C1 of the oblique end portion is apart from the axis Xr by a distance S in the direction perpendicular to the axis Xr, or parallel with the Y-axis. Therefore, the distance S is calculated as $S=R1\cdot\sin(\theta)$. If each roller 28 is moved toward the axis Xr, it will trace each locus or path as indicated by two-dot chain lines in FIG. 6, whereby the end portion of the cylinder 4 will not be formed properly. In order to form a proper end portion, the main shaft 21 should be set on the axis Xe. Accordingly, the axis Xe is used for a forming target axis in this embodiment, so that the cylinder 4 is moved perpendicularly to the axis Xr along the Y-axis guide rails 10, downward in FIG. 6, by the distance S. The geometric relationship between the main shaft 21 (represented by the axis Xr) and the cylinder 4 will be as shown in FIG. 7, wherein the axis Xr and the forming target axis Xe are overlapped. Thus, out of five paths shown by two-dot chain lines in FIG. 7, the last path indicates the configuration to be formed, which has the central axis corresponding to the forming target axis Xe, i.e., the oblique axis of the reduced diameter portion to be formed. As a result, the one end portion of the cylinder 4 is formed into the tapered portion 4*b* and neck portion 4*c* having the oblique axis Xe inclined against the central axis Xt of the cylinder 4 as shown in FIG. 8.

In operation, referring to FIG. 2, when the upper clamp 17 is lifted upward, the cylinder 4 to be formed is placed on the clamp face 13*a* of the lower clamp 13, and set at the predetermined position where the one end portion of the cylinder 4 is abutted on the stopper 19. Then, the actuator 18 is driven, so that the upper clamp 17 is moved downward, and the cylinder 4 is clamped between the lower clamp 13 and upper clamp 17, and held not to be rotated. In this case, the cylinder 4 is positioned such that the axis Xt of the cylinder 4 is aligned with the axis Xr of the main shaft 21. The transmitting member 26 is positioned at a retracted position, i.e., the right side to the position as shown in FIG. 2, so that each roller 28 is retracted outside of the outer periphery of the cylinder 4. Next, the motor 31 is driven to rotate the lower clamp 13 about the its output shaft 31*a* by the predetermined oblique angle θ. Since the guide roller 33 mounted on the lower clamp 13 is fitted into the guide groove 32 formed on the upper surface of the table 6, the lower clamp 13 can be rotated along the guide groove 32 about the shaft 31*a* (i.e., the center C0) to form the oblique angle θ between the axis Xr and the axis Xt as shown in FIG. 6. Therefore, the oblique axis or forming target axis Xe is set. Then, the spline shaft 15 is rotated by the motor 16, so that the clamp device 12 and the cylinder 4 are moved along the Y-axis guide rails 10 to position the forming target axis Xe in line with the axis Xr of the main shaft 21. Accordingly, the forming target axis Xe and the axis Xr are overlapped, as shown in FIG. 7. Next, the spline shaft 8 is rotated by the motor 9, so that the case 20 is advanced along the X-axis guide rails 5 (moved leftward in FIGS. 2 and 3), and stopped at a position for starting the spinning process, which corresponds to the center C1 in FIG. 7, and which position is set as an origin.

From the state as described above, the rotary member 24 is rotated by the motor 22, and the transmitting member 26 is advanced by the actuator 25, so that each roller 28 is moved toward the center of the rotary member 24, or the axis Xr. At the same time, the spline shaft 8 is rotated by the motor 9, the case 20 and the roller 28 are retracted along the X-axis guide rails 5 (rightward in FIGS. 2 and 3). Consequently, each roller 28 is rotated about its axis and rotated about the axis Xr of the main shaft 21, which is overlapped with the forming target axis Xe in this case, simultaneously, and moved radially toward the axis Xe, being pressed to be in contact with the outer surface of the cylinder 4, thereby to perform the spinning process. Thus, each roller 28 is started to move from the starting position, until the end portion of the cylinder is deformed by spinning, to form the tapered portion for the first cycle. In the case where each roller 28 is retracted further, exceeding the predetermined distance, the roller 28 is held to be in its state, so that the end portion of the cylinder 4 is deformed in accordance with the retracting movement of each roller 28 to form the cylindrical neck portion for the first cycle, which has the oblique axis inclined against the axis Xt by the oblique angle θ, and which is integrally connected to the smallest diameter side of the tapered portion 4*b*.

Thereafter, the cylinder 4 and roller 28 are returned to the starting positions, thereby to provide a reciprocating motion together with the initial path for reducing the diameter of the cylinder 4, so that the spinning process is completed. For simplifying the explanation about the spinning process, the operation for reducing the diameter is performed only in a single path of the reciprocating motion according to the present embodiment. However, the operation for reducing the diameter of the cylinder 4 may be performed in another path of the reciprocating motion as well, to perform the spinning process in both of the paths in one cycle, thereby to improve the forming efficiency. Furthermore, in view of the energy efficiency and tact-time, each roller 28 is continuously rotated about the axis Xr, without being stopped every cycle.

After the spinning process in the first cycle was completed and each roller 28 was returned to the starting position, the spinning process in the second cycle is performed. In practice, the spline shaft 8 is rotated by the motor 9, the case 20 and each roller 28 are advanced, and stopped in the state where each roller 28 is located in a second position retracted from the tip end of the cylinder 4 by a predetermined length. Then, the rotary member 24 is rotated, and the transmitting member 26 is advanced, so that each roller 28 is driven radially toward the axis Xr, and then each roller 28 is retracted along the X-axis guide rails 5, being pressed to be in contact with the outer surface of the cylinder 4 thereby to perform the spinning process. By repeating the process as described above three more times, in the present embodiment, the end portion of the cylinder 4 is formed into the reduced diameter portion 4*d* with the tapered portion 4*b* and neck portion 4*c* having the oblique axis as shown in FIG. 8.

According to the above-described embodiment, the diameter of the end portion of the cylinder is reduced along the oblique axis Xe, in accordance with a single relative rotating motion between the axis Xr and the axis Xt in setting the oblique axis. Therefore, if the distance between the oblique axis Xe and the axis Xr is large, the diameter of the rotating motion of the roller 28 about the cylinder 4 will be large and inertia moment of the roller will be large. As a result, the apparatus will have to be large in scale. Furthermore, each roller 28 abuts on only a part of the outer surface of the cylinder 4 for a long period of time, an impact will be applied to the cylinder 4 to cause a vibration and noise.

Figure 9:
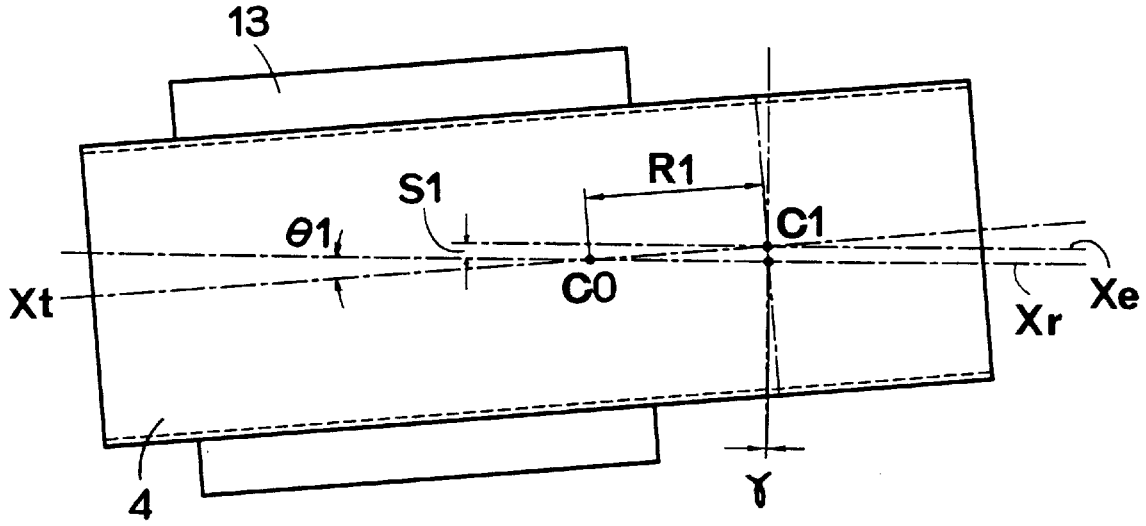
FIG. 9 is a plan view of a cylinder showing a second spinning process applied thereto according to an embodiment of the invention.
Figure 10:
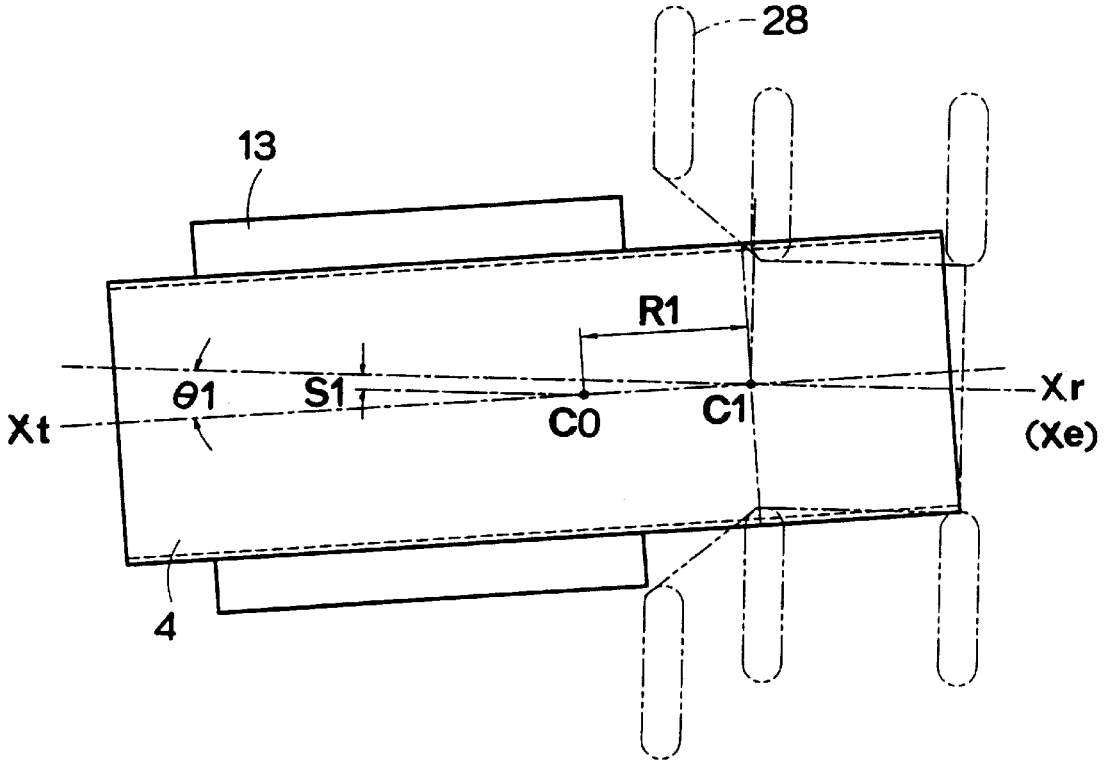
FIG. 10 is a plan view of a cylinder showing a second spinning process applied thereto according to an embodiment of the invention.
Figure 11:
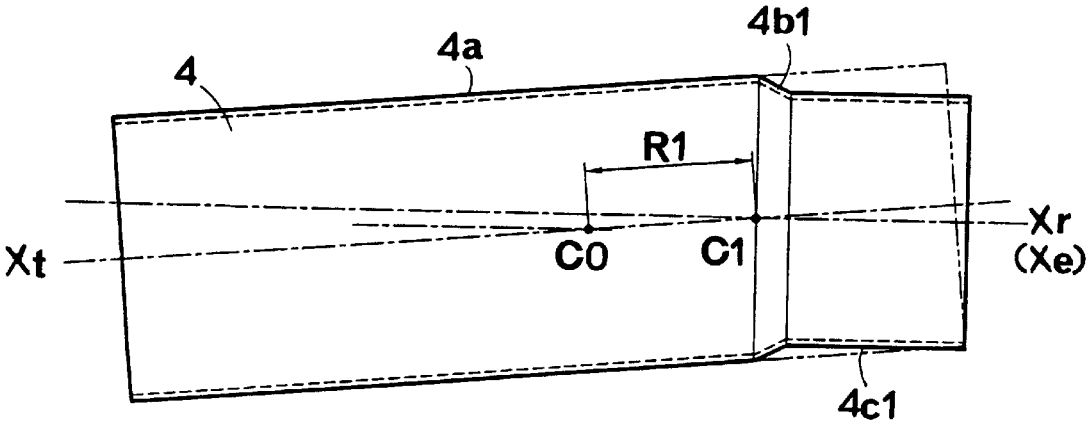
FIG. 11 is a plan view of a cylinder showing a second spinning process applied thereto according to an embodiment of the invention.
Figure 12:
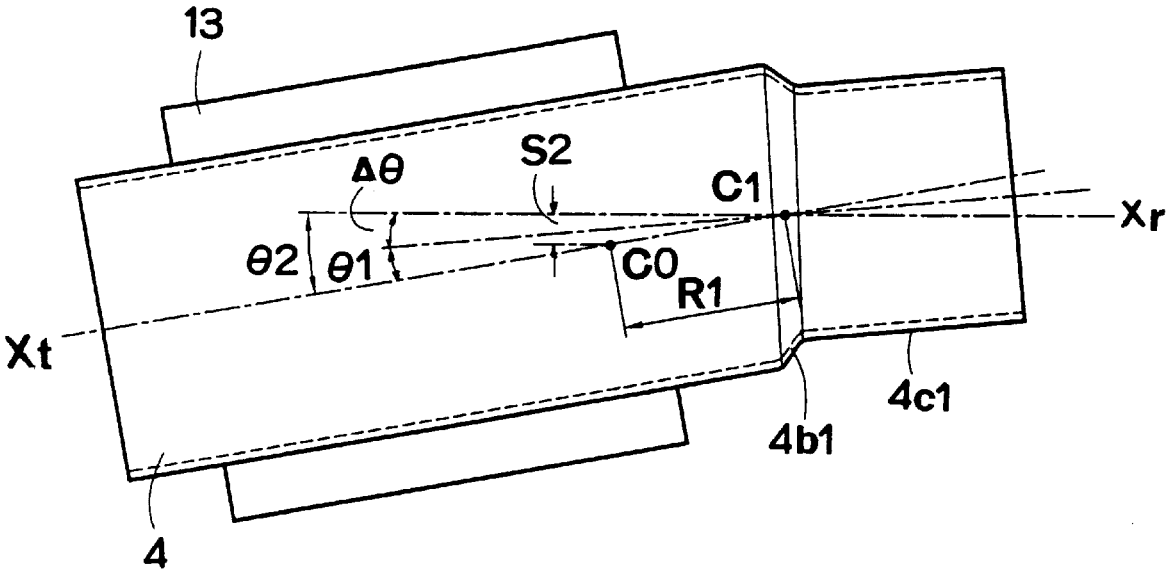
FIG. 12 is a plan view of a cylinder showing a second spinning process applied thereto according to an embodiment of the invention.
Figure 13:
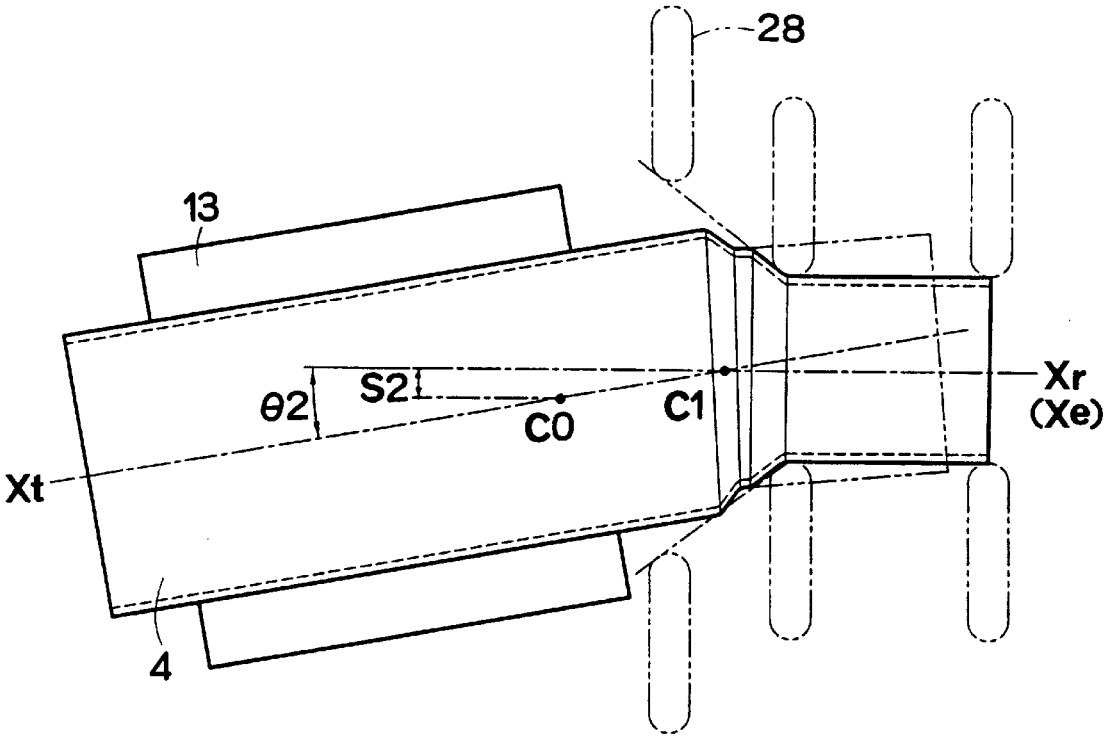
FIG. 13 is a plan view of a cylinder showing a second spinning process applied thereto according to an embodiment of the invention.
Figure 14:
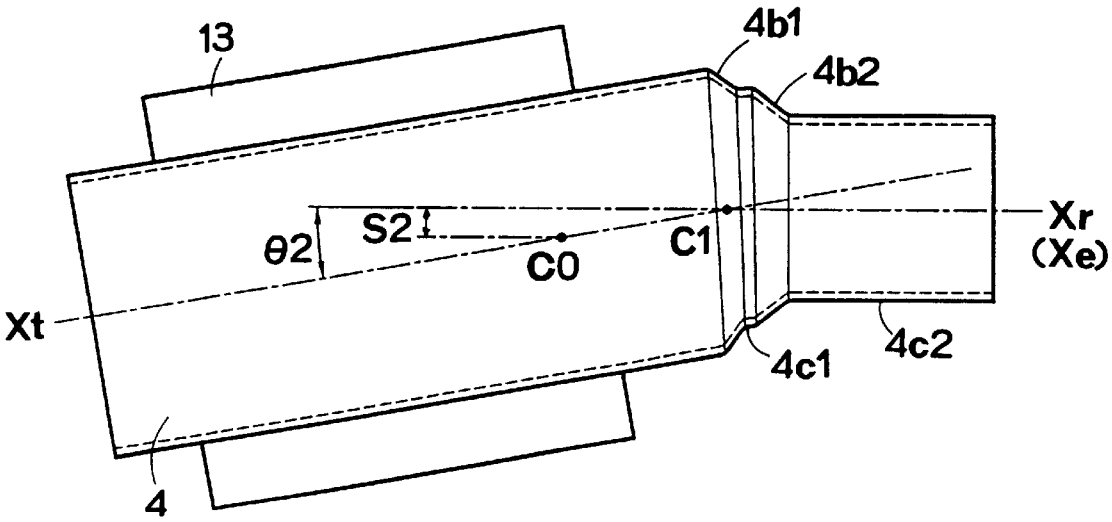
FIG. 14 is a plan view of a cylinder formed by a second spinning process according to an embodiment of the invention.
Figure 15:
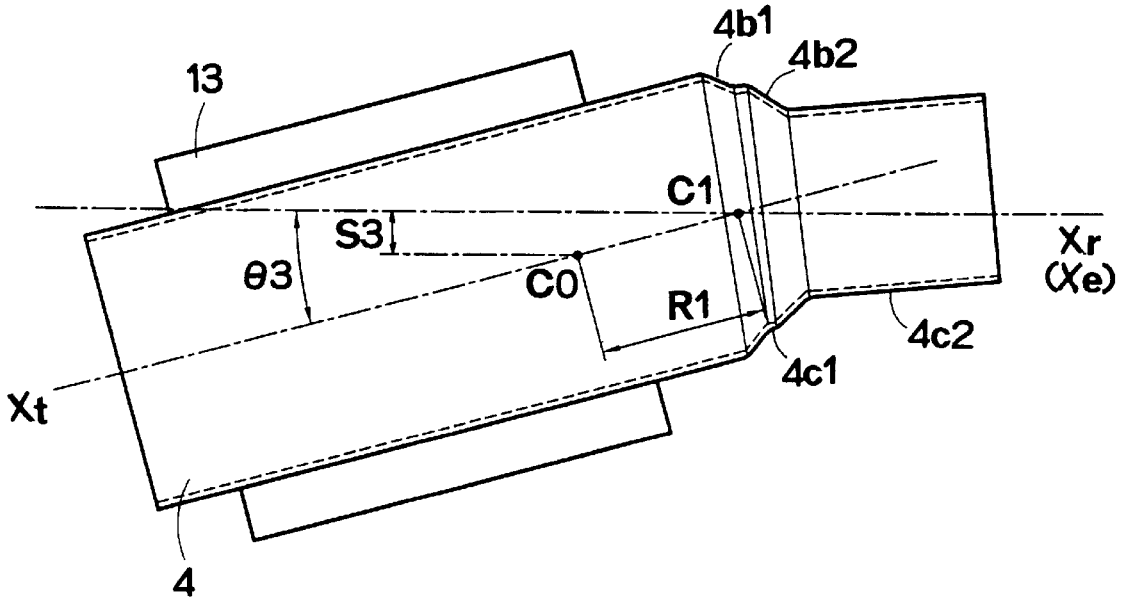
FIG. 15 is a plan view of a cylinder showing a second spinning process applied thereto according to an embodiment of the invention.
Figure 16:
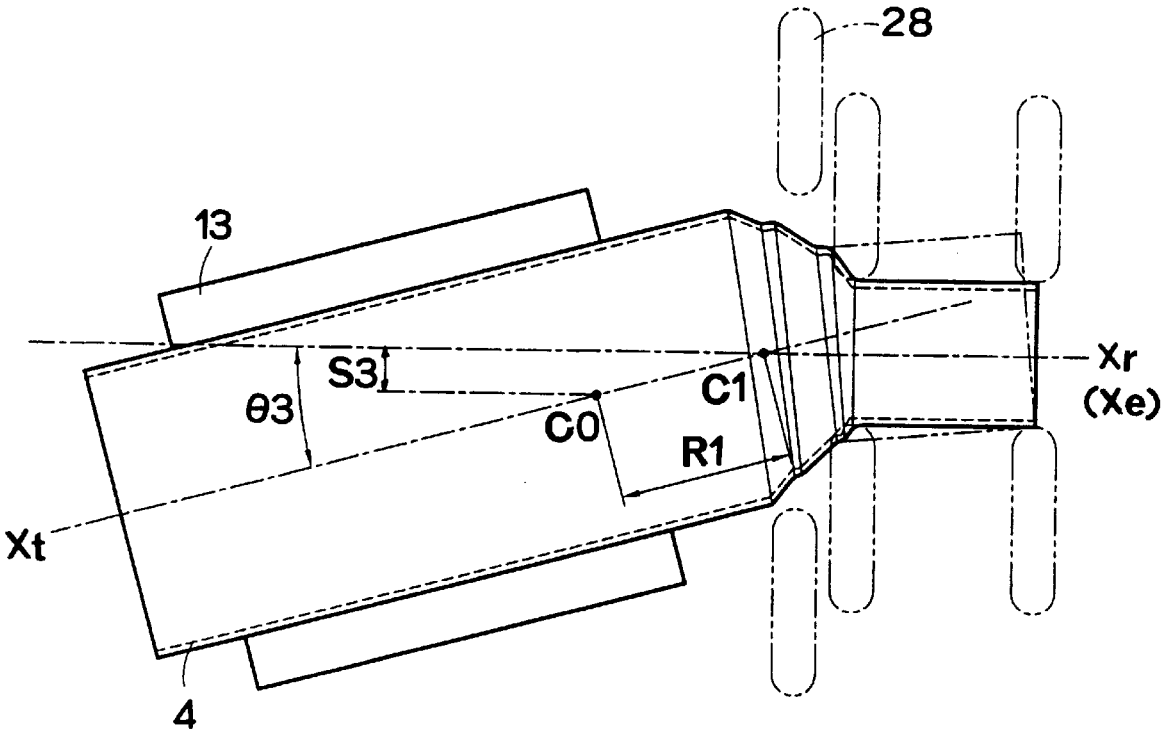
FIG. 16 is a plan view of a cylinder showing a second spinning process applied thereto according to an embodiment of the invention.
Figure 17:
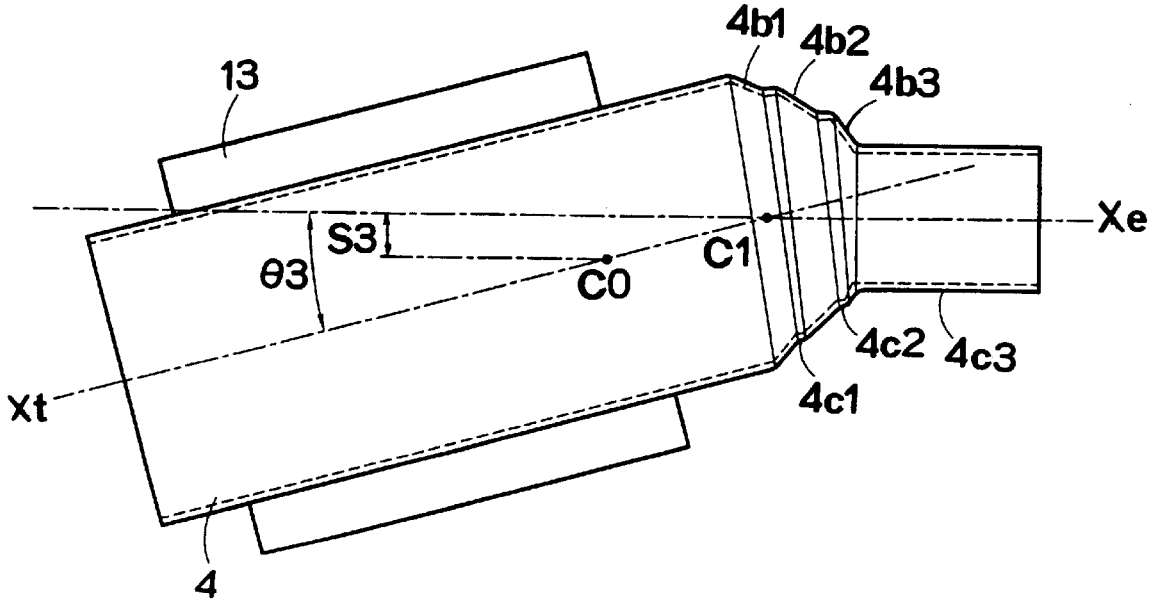
FIG. 17 is a plan view of a cylinder formed by a second spinning process according to an embodiment of the invention.

In the case where those problems are to be solved, a plurality of relative rotating motions between the axis Xr and the axis Xt are performed in setting the oblique axis, in accordance with another embodiment as explained hereinafter with reference to FIGS. 9–17. FIG. 9 illustrates a state where the cylinder 4 (axis Xt) is rotated about the center C0 relative to the main shaft 21 (axis Xr) by an angle θ1. In this case, the forming target axis Xe is offset from the axis Xr of the main shaft 21, along the Y-axis by a distance (S1=R1·sin θ1). Also, the center C1 is offset along the X-axis by a distance γ=R1·tan(θ1)·sin(θ1). According to the present embodiment, therefore, by moving the cylinder 4 relative to the main shaft 21 by the distance S1 and distance γ (hereinafter omitted for simplicity), the axis Xr and the forming target axis Xe are overlapped, as shown in FIG. 10. Accordingly, the cylinder 4 as shown in FIG. 11 is formed with the tapered portion 4*b*1 and neck portion 4*c*1 having the oblique axis Xe overlapped with the axis Xr of the main shaft 21 and inclined against the central axis Xt of the cylinder 4 by the angle θ1. FIG. 12 illustrates a state where the cylinder 4 (axis Xt) is rotated about the center C0 relative to the main shaft 21 (axis Xr) further, to provide an angle 02 added to the angle θ1 by an angle A0, and the cylinder 4 is moved relative to the main shaft 21 by the distance S2. Therefore, the axis Xr and the forming target axis Xe are overlapped, as shown in FIG. 13, and then the cylinder 4 is produced to form the tapered portion 4*b*2 and neck portion 4*c*2 in addition to the tapered portion 4*b*1 and neck portion 4*c*1, having the oblique axis Xe overlapped with the axis Xr of the main shaft 21 and inclined against the central axis Xt of the cylinder 4 by the angle θ2, as shown in FIG. 14. Then, as shown in FIG. 15, the cylinder 4 (axis Xt) is rotated further relative to the main shaft 21 (axis Xr) to provide an angle θ3 added to the angle θ2 by the angle Δθ, and the cylinder 4 is moved relative to the main shaft 21 by the distance S3, so that the axis Xr and the forming target axis Xe are overlapped, as shown in FIG. 16. Accordingly, the cylinder 4 is formed with the tapered portions 4*b*1, 4*b*2, 4*b*3 and neck portions 4*c*1, 4*c*2, 4*c*3 having the oblique axis Xe, as shown in FIG. 17.

Figure 18:
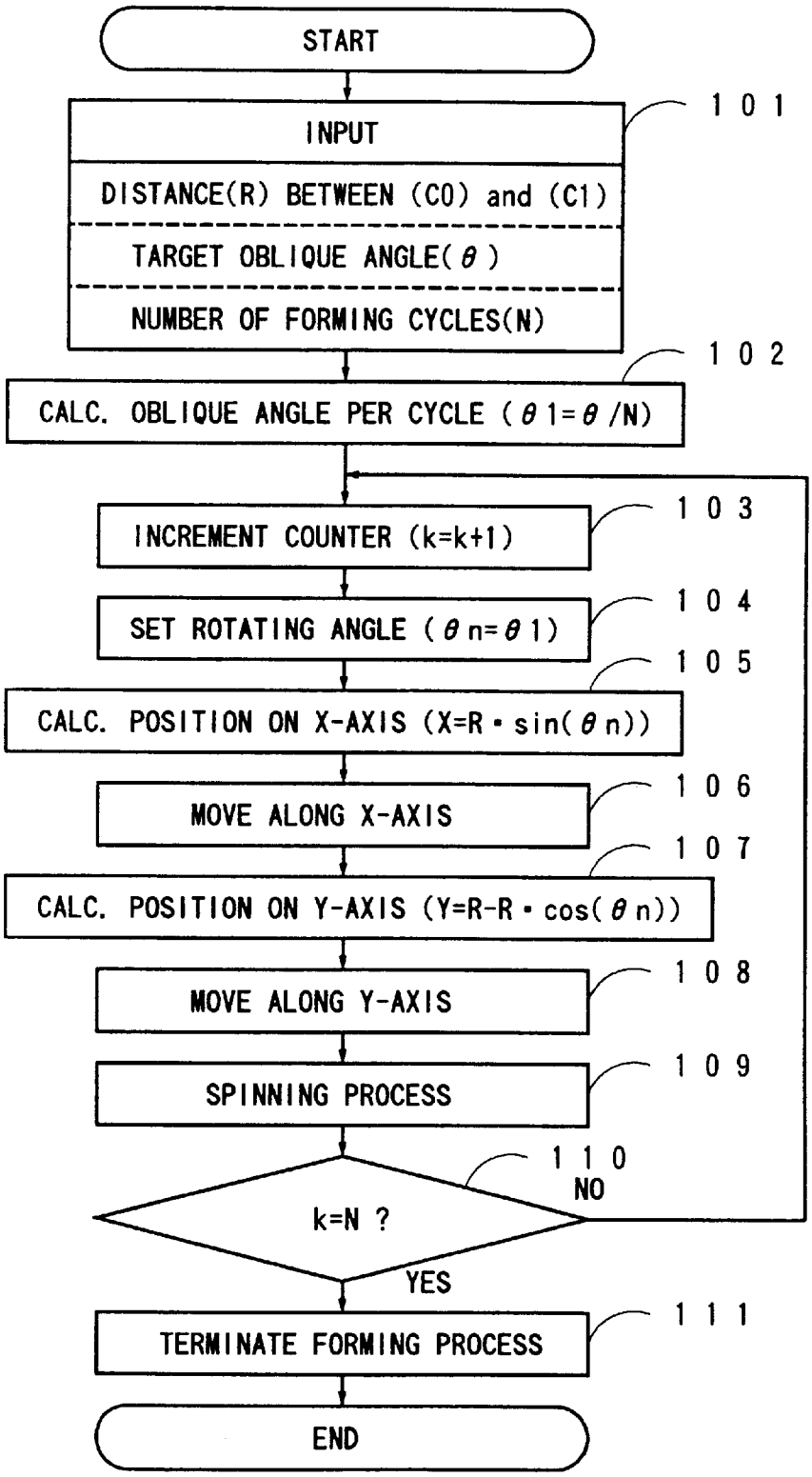
FIG. 18 is a flowchart showing a spinning process according to an embodiment of the invention.

Next will be explained the operation of the spinning process as explained above with reference to FIGS. 9–17, which will be performed by the controller CT in accordance with a flowchart as shown in FIG. 18. At the outset, various basic data are input by the input device IP at Step 101. The data input into the controller CT are the distance R between the center C0 and the center C1, target oblique angle θ and the number N of forming cycles. And, the oblique angle per one cycle θ1 is calculated (θ1=θ/N) at Step 102. Then, the program proceeds to step 103 where a counter for forming the cylinder is incremented (k=k+1), and a rotating angle On is set to the angle per one cycle θ1 at Step 104. The program proceeds to Step 105 where a position of the roller 28 to be located on the X-axis is calculated as X=R·sin(θn). And, the program proceeds to Step 106 where each rollers 28 is moved along the X-axis to be located at the position set at Step 105. Then, the program proceeds to Step 107 where the position of the roller 28 to be located on the Y-axis is calculated as Y=R−R·cos(θn), and proceeds to Step 108 where each roller 28 is moved along the Y-axis to be located at the position set at Step 107. With each roller 28 and the cylinder 4 located as described above, the spinning process is performed at a Step 109. When the counter has counted up the predetermined value N at Step 110, the program proceeds to Step 111 where the spinning process is terminated, so that each component will be returned to its starting position and the program will end. Whereas, when the counter has not counted up the predetermined value N at Step 110, Steps 103–109 are repeated.

Figure 19:
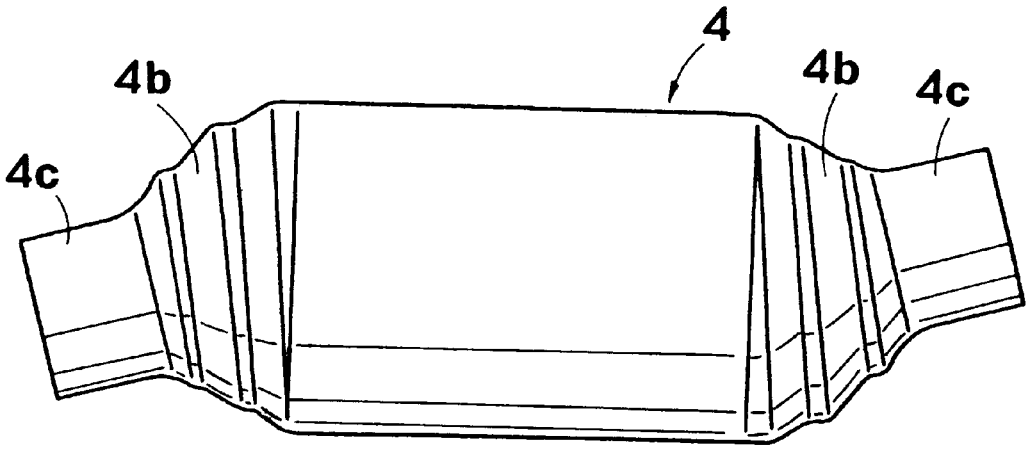
FIG. 19 is a side view of a finished cylinder according to an embodiment of the invention.
Figure 20:
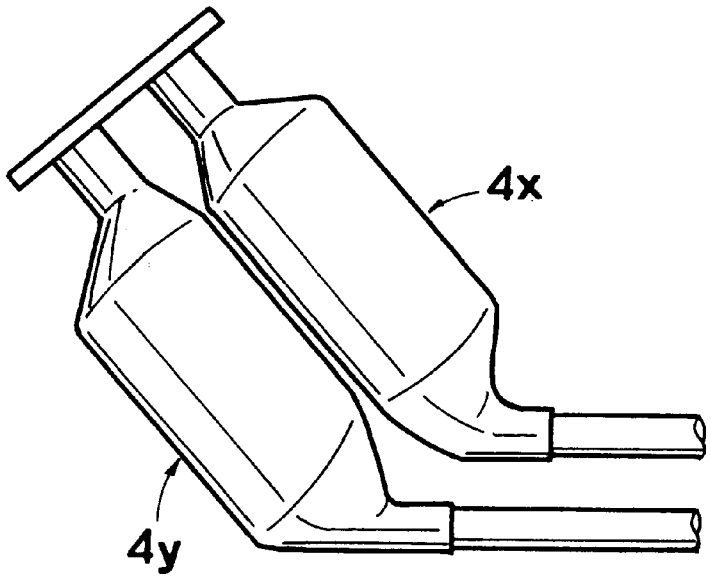
FIG. 20 is a side view of dual converters for use in an exhaust purifying system employing a cylinder formed according to an embodiment of the invention.

According to the above-described spinning apparatus, therefore, the cylinder 4 with the tapered portion 4*b* (including 4*b*1–4*b*3) and neck portion 4*c* (including 4*c*1–4*c*3) formed at its opposite end portions is produced, as shown in FIG. 19, and may be used for the housing of catalytic converter. Furthermore, two cylinders 4*x*, 4*y* of similar configuration to the cylinder 4 may be combined to produce an exhaust purifying system having dual converters, as shown in FIG. 20.

Figure 21:
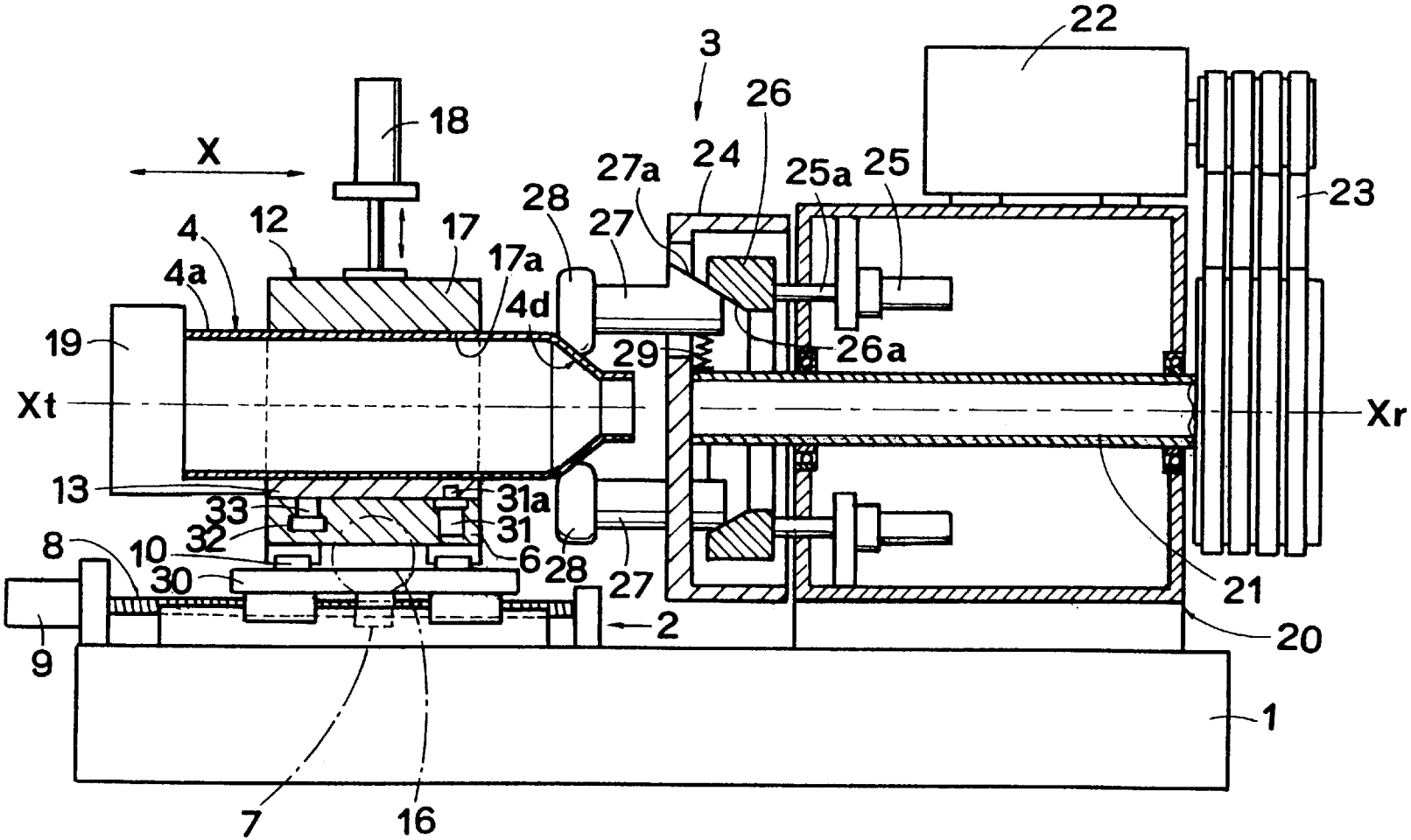
FIG. 21 is a side view of a spinning apparatus with a portion thereof sectioned according to another embodiment of the invention.
Figure 22:
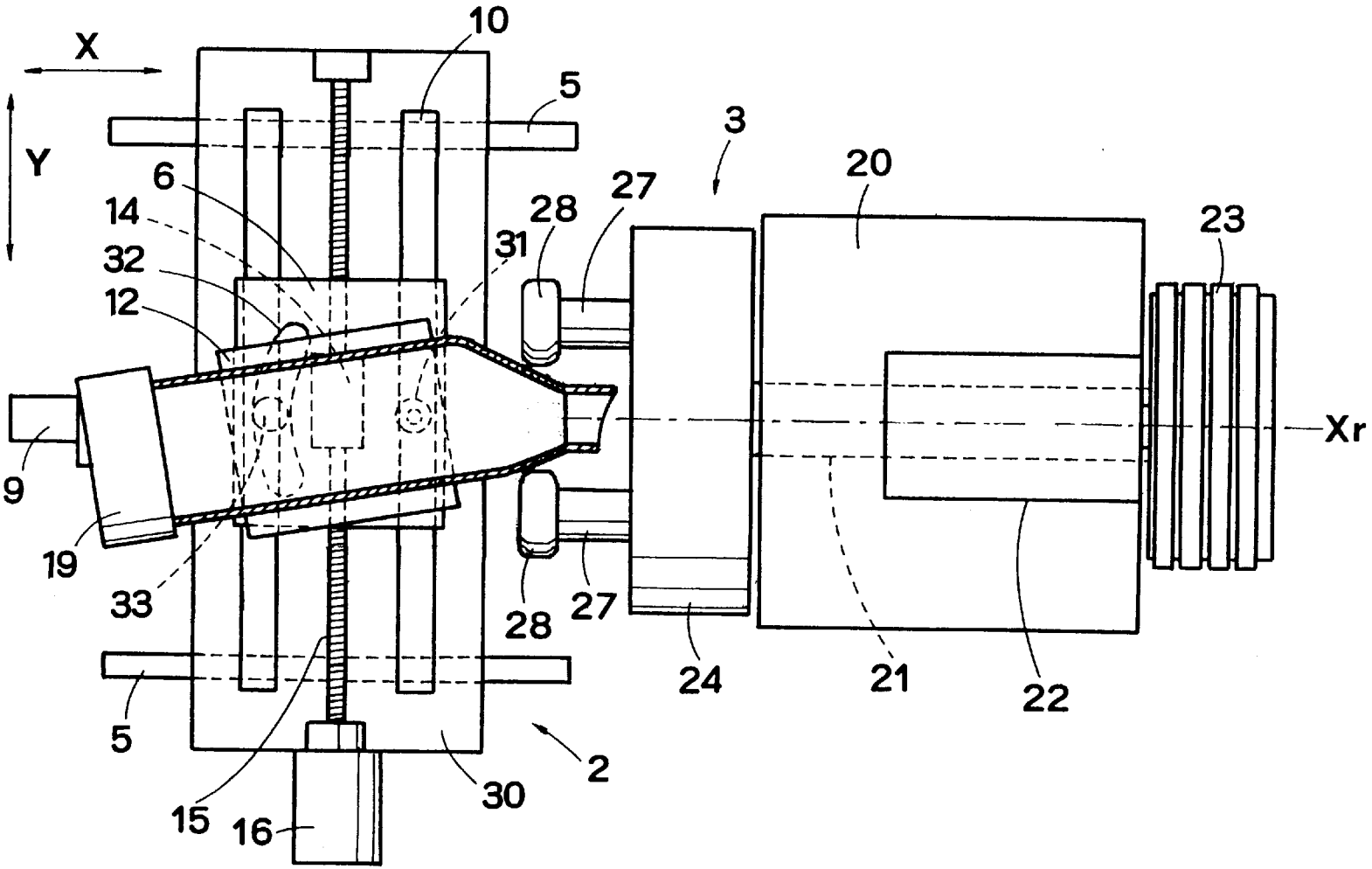
FIG. 22 is a plan view of a spinning apparatus with a portion thereof sectioned according to another embodiment of the invention.

FIGS. 21 and 22 illustrate the spinning apparatus according to another embodiment. In the embodiment as disclosed in FIGS. 2 and 3, the case 20 is moved along the X-axis and the cylinder 4 moved along the Y-axis, so that they are moved relative to each other, whereas according to the present embodiment, the case 20 is secured to the base 1, while the cylinder 4 is moved along the X-axis and Y-axis, and rotated about the shaft 31*a* of the motor 31. That is, the first driving mechanism 2 that serves as the first driving device according to the present invention are gathered in the left side in FIGS. 21 and 22. The rest of the components such as the second driving mechanism 3 are the same as those in the aforementioned embodiment. Therefore, the components in FIGS. 21 and 22 having substantially the same function as those in FIGS. 2 and 3 are identified by the same reference numerals in FIGS. 2 and 3.

In the first driving mechanism 2, a pair of X-axis guide rails 5 are fixedly secured to the base 1 at the left side thereof in FIGS. 21 and 22. A sliding base plate 30 is provided for mounting thereon the sliding table 6, the clamp device 12 and etc., and arranged to be movable along the X-axis guide rails 5. The ball socket 7 is secured to the base plate 30 thereunder, and the spline shaft 8 to be engaged with the ball socket 7 is mounted on the base 1 in parallel with the X-axis guide rails 5, to be rotated by the motor 9. Accordingly, when the spline shaft 8 is rotated by the motor 9, the base plate 30 is moved along the X-axis. Furthermore, a pair of Y-axis guide rails 10 are secured to the base plate 30 thereon, and a pair of sliders 11 are movably mounted on the Y-axis guide rails 10. The same clamp device 12 as shown in FIGS. 2 and 3 is mounted on the sliders 11, so that when the spline shaft 15 is rotated by the motor 16, the clamp device 12 is moved along the Y-axis relative to the base plate 30.

According to the invention, when the shaft 31*a* is driven by the motor 31, the clamp device 12 is rotated about the shaft 31*a*. When the spline shaft 8 is rotated by the motor 9, the clamp device 12 is advanced along the X-axis guide rails 5 (i.e., moved rightward in FIGS. 21 and 22), and when the spline shaft 15 is rotated by the motor 16, the clamp device 12 is moved along the Y-axis guide rails 10 (i.e., moved downward in FIG. 17). Accordingly, the clamp device 12 is stopped when the cylinder 4 is located at a position where it is moved to position the end portion of ;the cylinder 4 on the forming target axis. Then, the motor 22 is rotated by the rotary member 24, the transmitting member 26 is advanced by the actuator 25, and each roller 28 is moved toward the center of the rotary member 24 (i.e., the axis Xr). At the same time, the spline shaft 8 is rotated by the servo motor 9, so that the clamp device 12 and the cylinder 4 are retracted along the X-axis guide rails 5 (i.e., moved leftward in FIGS. 21 and 22). Consequently, each roller 28 is rotated about its axis and rotated about the axis Xr of the main shaft 21 simultaneously, to be moved radially toward the axis Xr, being biased to be in contact with the outer surface of the cylinder 4, thereby to perform the spinning process, in the same manner as in FIGS. 2 and 3.

In the embodiment as disclosed in FIGS. 2 and 3, the axis Xt of the cylinder 4 is fixed to a position of a predetermined height above the base 1, so as to be placed on the same plane as the axis Xr of the main shaft 21 in parallel with the base 1. The height of the axis Xt of the cylinder 4 to the base 1 may be adapted to be variable, and the axis Xt may be adjusted vertically relative to the axis Xr of the main shaft 21. In other words, the apparatus may be provided with a third driving mechanism (not shown) that drives the cylinder 4 vertically, in addition to the first driving mechanism 2 and second driving mechanism 3 as those shown in FIGS. 2 and 3. In this case, therefore, the axis Xt of the cylinder 4 can be adjusted to be located at a predetermined vertical position relative to the base 1, and the axis Xt can be adjusted vertically relative to the axis Xr of the main shaft 21, so that a fine adjustment will be made easily in the spinning process.

Figure 23:
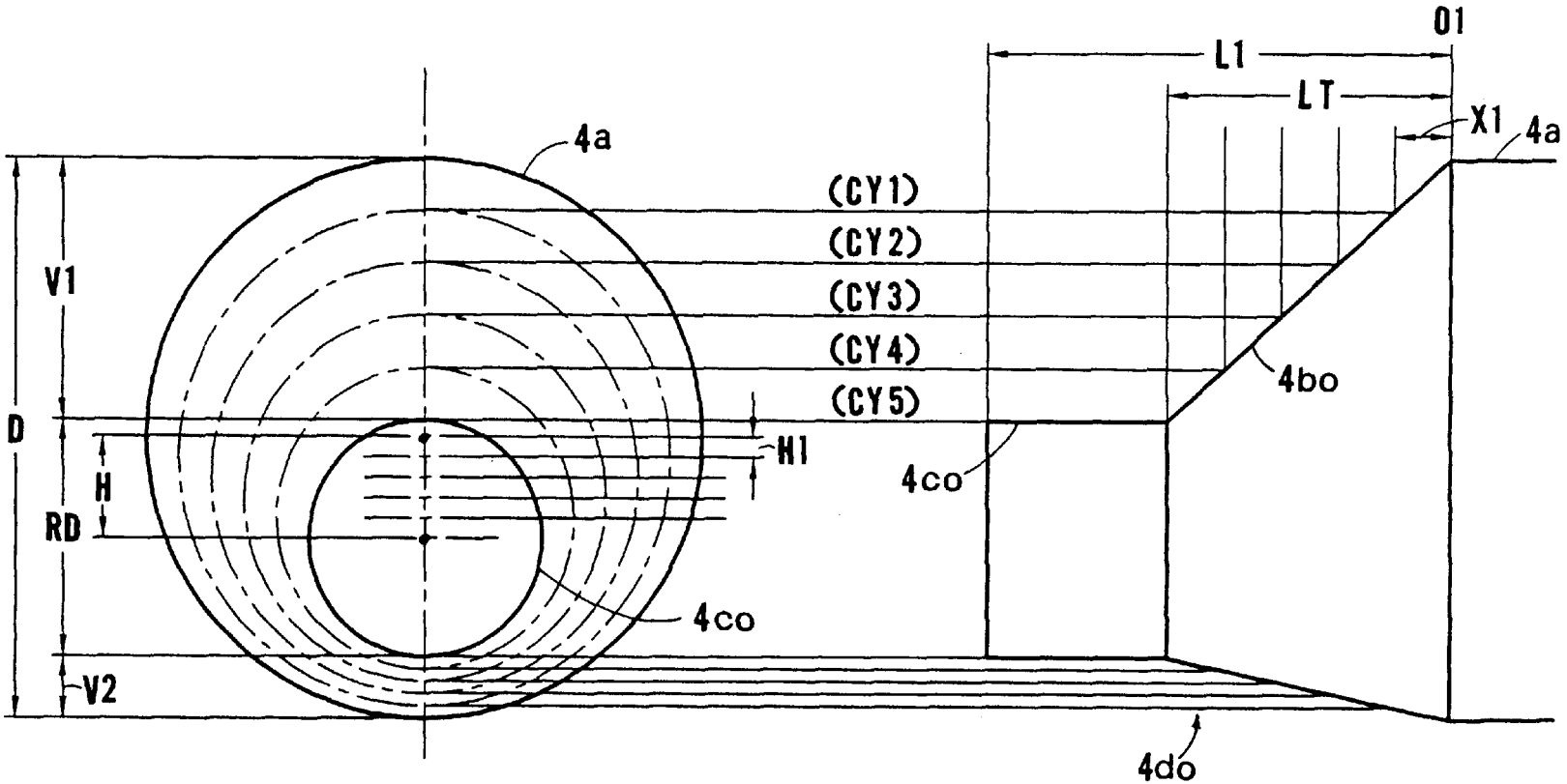
FIG. 23 is a diagram showing a basic concept for reducing the diameter of an end portion of a cylinder formed according to an embodiment of the spinning apparatus.
Figure 24:
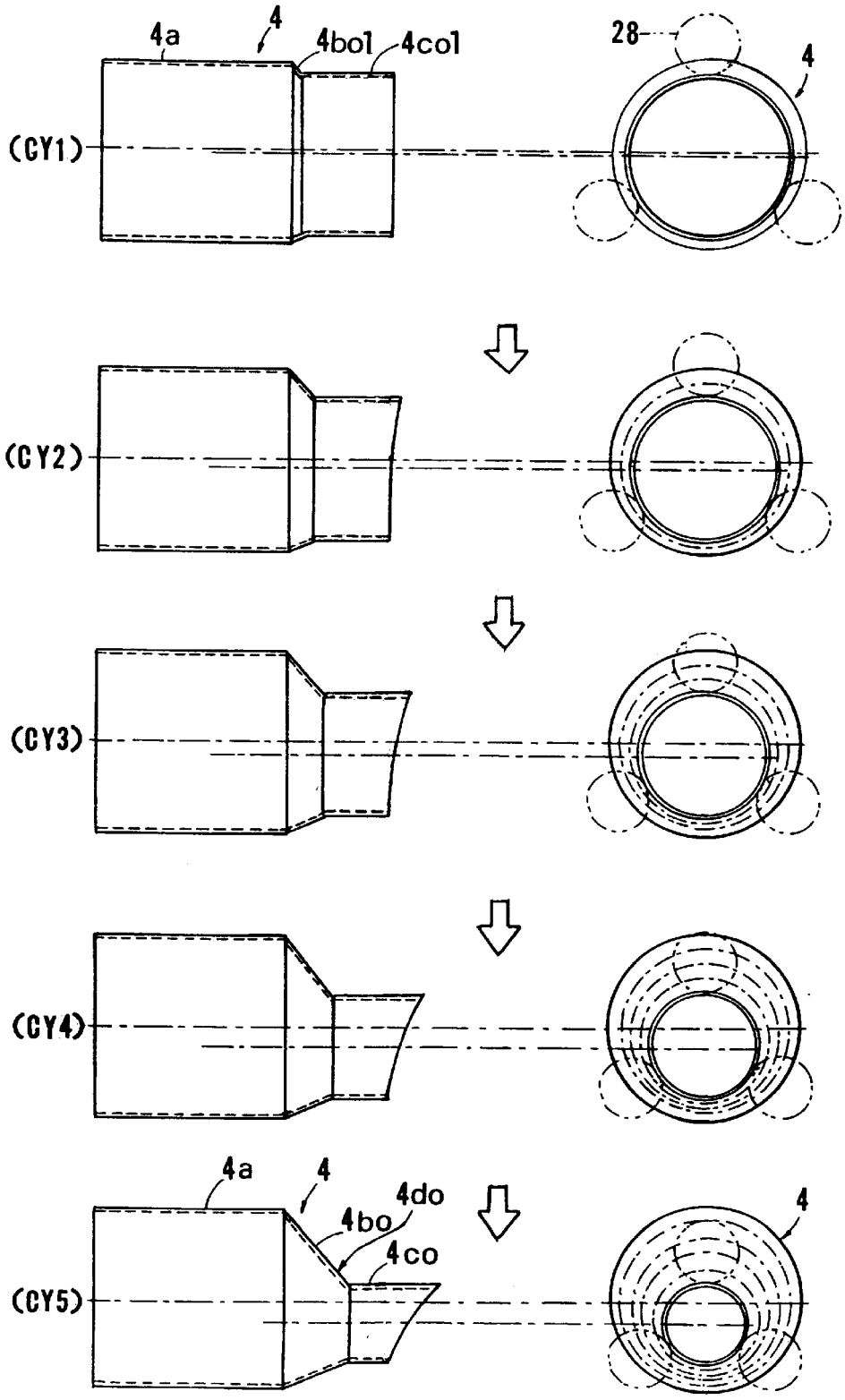
FIG. 24 is a front view and side view of an end portion of a cylinder formed according to an embodiment of the spinning apparatus.

Referring to FIGS. 23 and 24, there will be explained a method for reducing the end portion of a cylinder 4 by means of the aforementioned spinning apparatus to form a reduced diameter end portion having an eccentric axis offset from the central axis of the cylinder 4. A thick solid line in FIG. 23 indicates an estimated configuration of the finished cylinder 4, which includes the main body 4*a*, and the tapered portion 4*bo* and neck portion 4*co* which form the reduced diameter portion 4*do*. At the outset, a starting position O1 for starting the spinning process is set to a position retracted from the tip end of the cylinder 4*a* forming distance L1. When the tapered portion 4*bo* is formed, the offset amount H is divided by a number N of predetermined forming cycles (N=5, according to the embodiment in FIG. 23), so that a moving distance toward the eccentric axis every cycle. i.e., moving distance H1 along the Y-axis per one cycle, is set. In this embodiment, each moving distance amount may be altered in accordance with the forming process to be required. For example, the moving distance between the cycles in an initial stage of the forming process may be made relatively long to reduce the forming time period, or the moving distance between the cycles in a terminating stage of the forming process may be made relatively short to improve the finished accuracy of the product. Likewise, with respect to the longitudinal length, a tapered length LT is divided by the predetermined forming cycles (N=5), so that a moving distance X1 along the X-axis per one cycle, is set.

In FIG. 23, "D" indicates a diameter of the main body 4*a* of the cylinder 4, "RD" indicates the smallest diameter of the tapered portion 4*bo* which is equal to the diameter of a portion 4*co*. "V1" indicates a reduced amount of the diameter of a portion to be formed to a large extent, and "V2" indicates a reduced amount of the diameter of a portion to be formed to a small extent. "CY1" to "CY5" indicate the cycles of the forming process. The number N of forming cycles is selected properly in view of the limit for reducing the diameter of the cylinder 4. According to the invention, the moving distance per one cycle is set to a value which does not exceed the limit for reducing the diameter of the cylinder. The limit for reducing the diameter of the cylinder is the limit at which plastic deformation working of the cylinder can not be made appropriately due to a material characteristic of the cylinder.

In operation, referring to FIG. 2, when the upper clamp 17 is lifted upward, the cylinder 4 to be formed is placed on the clamp face 13*a* of the lower clamp 13, and set at the predetermined position where the one end portion of the cylinder 4 is abutted on the stopper 19. Then, the actuator 18 is driven, so that the upper clamp 17 is moved downward, and the cylinder 4 is clamped between the lower clamp 13 and upper clamp 17, and held not to be rotated. In this case, the clamp device 12 is positioned such that the axis Xt of the cylinder 4 is aligned with the axis Xr of the main shaft 21. The transmitting member 26 is positioned at a retracted position, i.e., the right side to the position as shown in FIG. 2, so that each roller 28 is retracted outside of the outer peripheral of the cylinder 4. Next, the spline shaft 8 is rotated by the motor 9, so that the case 20 is advanced along the X-axis guide rails 5 (moved leftward in FIGS. 2 and 3), and stopped at a position where each roller 28 is retracted from the tip end of the cylinder 4 the forming length (L1 in FIG. 23). In other words, each roller 28 is positioned at the position 01 for starting the spinning process as shown in FIG. 23, which position is set as the origin. Then, the spline shaft 15 is rotated by the motor 16, and the clamp device 12 is moved along the Y-axis guide rails 10 (moved downward in FIG. 3), and stopped at a position where the cylinder 4 is moved along the Y-axis guide rails 10 by the offset moving distance H1 moved toward the eccentric shaft per one cycle. The starting position of the cylinder 4 may be set to a position where the axis Xt of the cylinder 4 is moved toward the axis Xr of the main shaft 21 along the Y-axis by the moving distance H1.

From the state as described above, the rotary member 24 is rotated by the motor 22, and the transmitting member 26 is advanced by the actuator 25, so that each roller 28 is moved toward the center of the rotary member 24, or the axis Xr. At the same time, the spline shaft 8 is rotated by the motor 9, the case 20 and the roller 28 are retracted along the X-axis guide rails 5 (rightward in FIGS. 2 and 3). Consequently, each roller 28 is rotated about its axis and rotated about the axis Xr of the main shaft 21 simultaneously, and moved radially toward the axis Xr, being pressed to be in contact with the outer surface of the cylinder 4, thereby to perform the spinning process. Thus, each roller 28 is started to move from the starting position 01, until each roller 28 moves the moving distance X1, the end portion of the cylinder is deformed by spinning, to form a tapered portion 4*bo*1 with its axis offset from the axis Xt of the main body 4*a* by the moving distance H1, as shown in CY1 of FIG. 24, because the axis Xr, about which the roller 28 is rotated, is offset relative to the axis Xt of the cylinder 4 by the moving distance H1.

In the case where each roller 28 is retracted further, exceeding the moving distance X1, the roller 28 is held to be in its state (i.e., the position moved the predetermined distance H1). Therefore, the end portion of the cylinder 4 is deformed in accordance with the retracting movement of each roller 28 to form a cylindrical neck portion 4*co*1, which was the central axis offset relative to the axis Xt of the main body 4*a* by the distance H1, and which is integrally connected to the smallest diameter side of the tapered portion 4*bo*1. Thereafter, the cylinder 4 and roller 28 are returned to the starting positions, thereby to provide a reciprocating motion together with the initial path for reducing the diameter of the cylinder 4, so that the spinning process in the first cycle CY1 is completed. The operation for reducing the diameter of the cylinder 4 may be performed in another path of the reciprocating motion as well. After the spinning process in the first cycle CY1 was completed an each roller 28 was returned to the starting position, the spinning process in the second cycle CY2 is performed in the same manner as described above. By repeating the process as described five times, in the present embodiment, the reduced diameter portion 4*do* with the tapered portion 4*bo* and neck portion 4*co* having the eccentric axis is formed.

Figure 25:
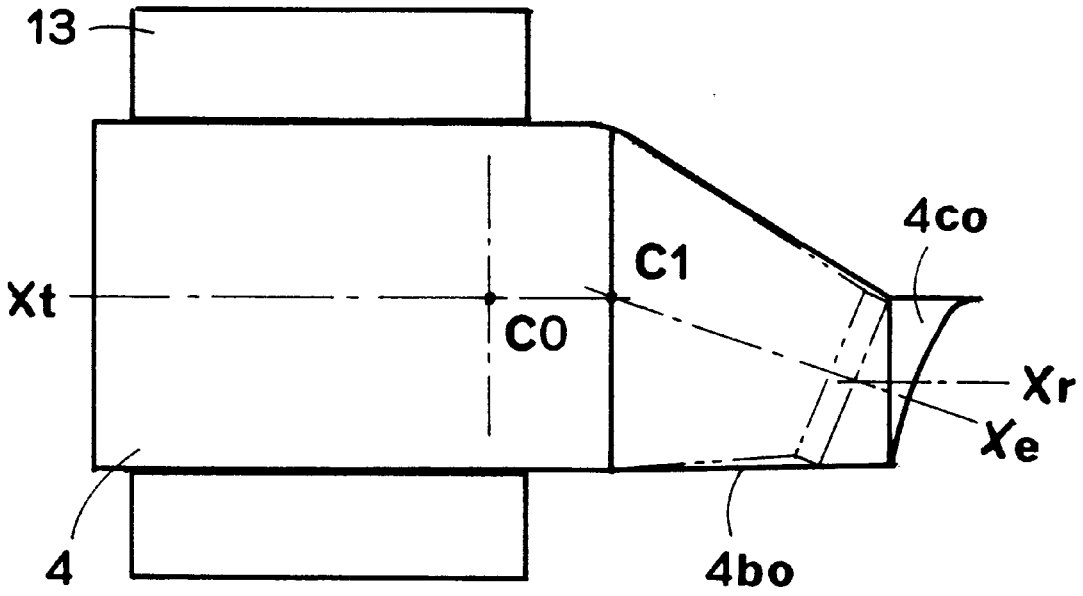
FIG. 25 is a plan view of a cylinder showing a third spinning process applied thereto according to an embodiment of the invention.
Figure 26:
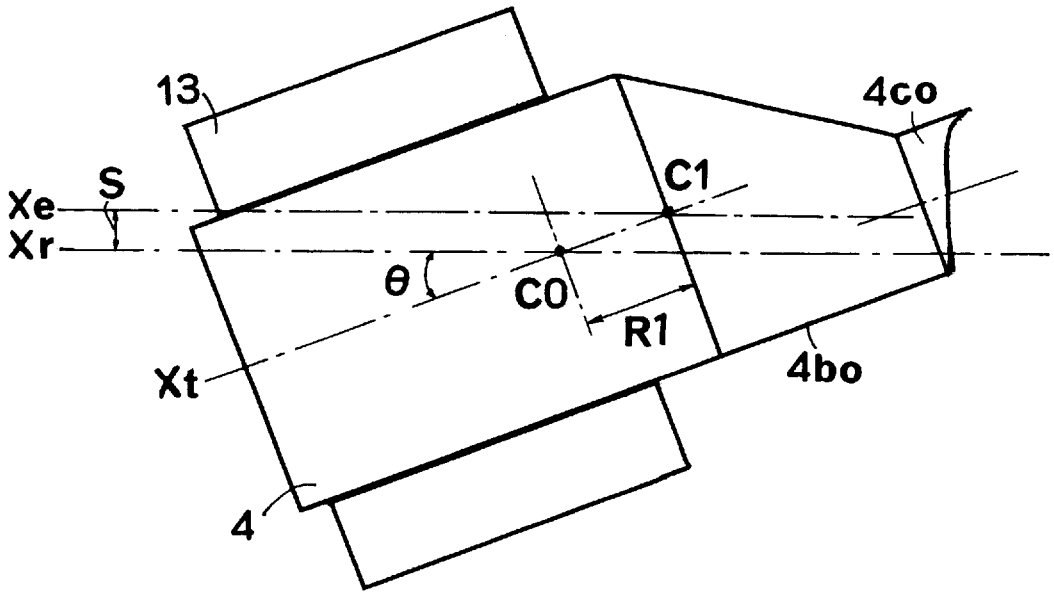
FIG. 26 is a plan view of a cylinder showing a third spinning process applied thereto according to an embodiment of the invention.

FIGS. 25–29 relate to a further embodiment of the spinning method, wherein the end portion of the cylinder 4 is formed into the reduced diameter end portion having the eccentric axis and the oblique axis, by means of the apparatus as shown in FIGS. 2 and 3. At the outset, according to the method as explained with reference to FIGS. 23 and 24, the end portion of the cylinder 4 is formed into the tapered portion 4*bo* and neck portion 4*co* having the axis, as shown in FIG. 25, wherein the two-dot chain line indicates the configuration to be formed, which was the oblique axis and the eccentric axis. Next, the axis Xr of the main shaft 21 is fixed on the plane in parallel with the base 1, while the cylinder 4 is rotated about the center C0, to produce the oblique angle θ as shown in FIG. 26. In this case, the oblique axis, or forming target axis Xe is positioned to be in parallel with the axis Xr and to include the center C1 of the oblique end portion, which center is apart from the axis Xr by the distance $S=R1\cdot\sin(\theta)$ in the direction parallel with the Y-axis. Therefore, the cylinder 4 is moved perpendicularly to the axis Xr along the Y-axis guide rails 10, downward in FIG. 26, by the distance S, so that the axis Xr and the forming target axis Xe are overlapped.

Figure 27:
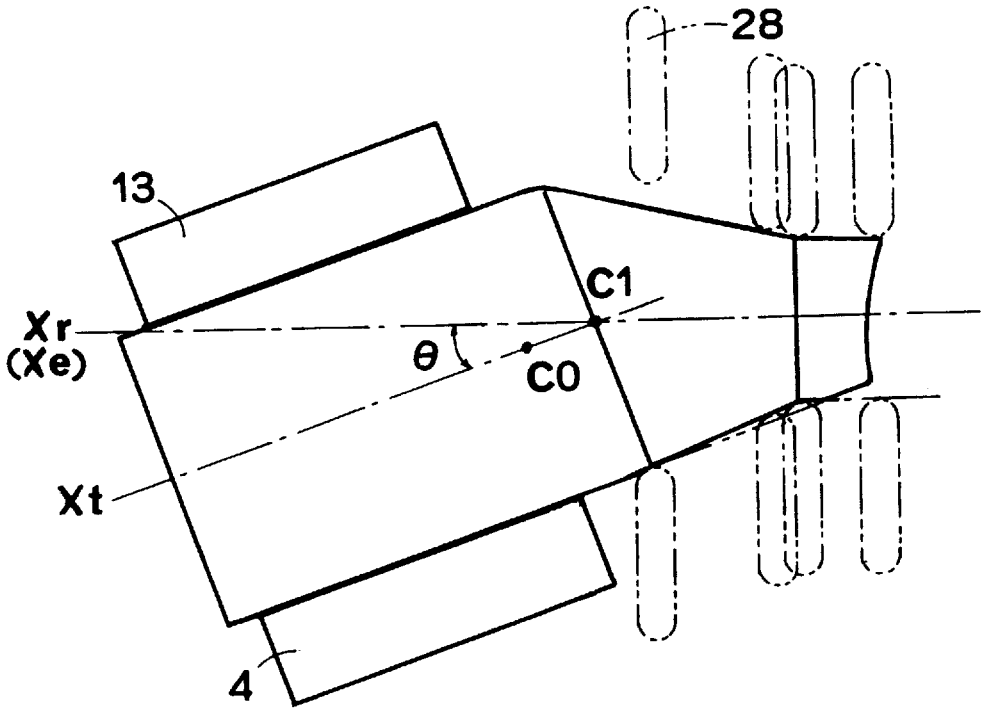
FIG. 27 is a plan view of a cylinder showing a third spinning process applied thereto according to an embodiment of the invention.
Figure 28:
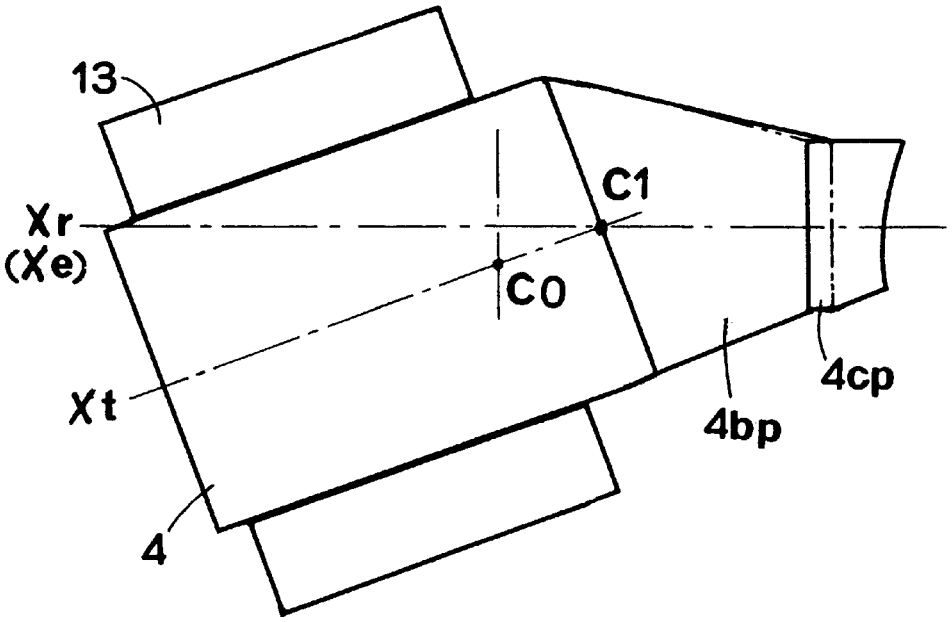
FIG. 28 is a plan view of a cylinder showing a third spinning process applied thereto according to an embodiment of the invention.
Figure 29:
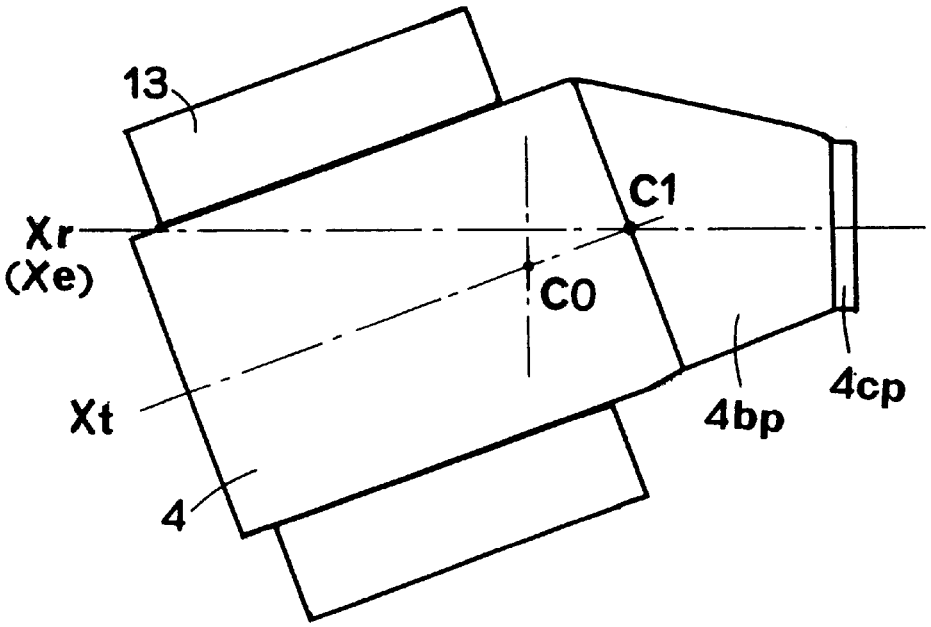
FIG. 29 is a plan view of a cylinder showing a third spinning process applied thereto according to an embodiment of the invention.

Then, as shown by two-dot chain line in FIG. 27, each roller 28 is rotated its axis and about the axis Xr (the forming target axis Xe) simultaneously, and moved radially toward the axis Xr, being pressed to be in contact with the outer surface of the cylinder 4, thereby to perform the spinning process. As a result, the one end portion of the cylinder 4 is formed into the tapered portion 4*bp* and neck portion 4*cp* having the oblique axis inclined against the axis Xt of the cylinder 4, as shown in FIG. 28, then its tip end portion is cut out to form the tapered portion 4*bp* and neck portion 4*cp*, as shown in FIG. 29.

Figure 30:
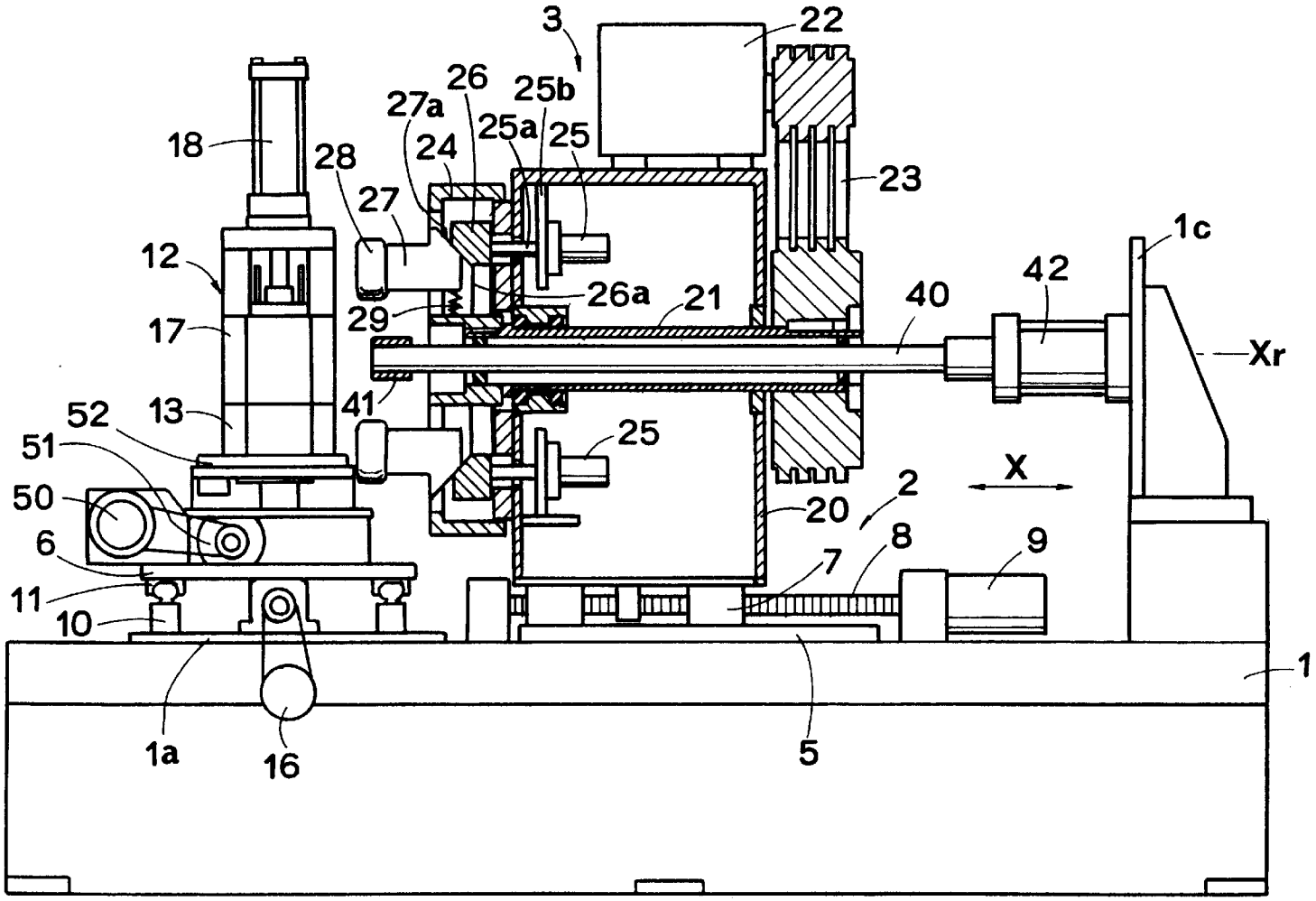
FIG. 30 is a side view of a spinning apparatus with a portion thereof sectioned according to a further embodiment of the invention.
Figure 31:
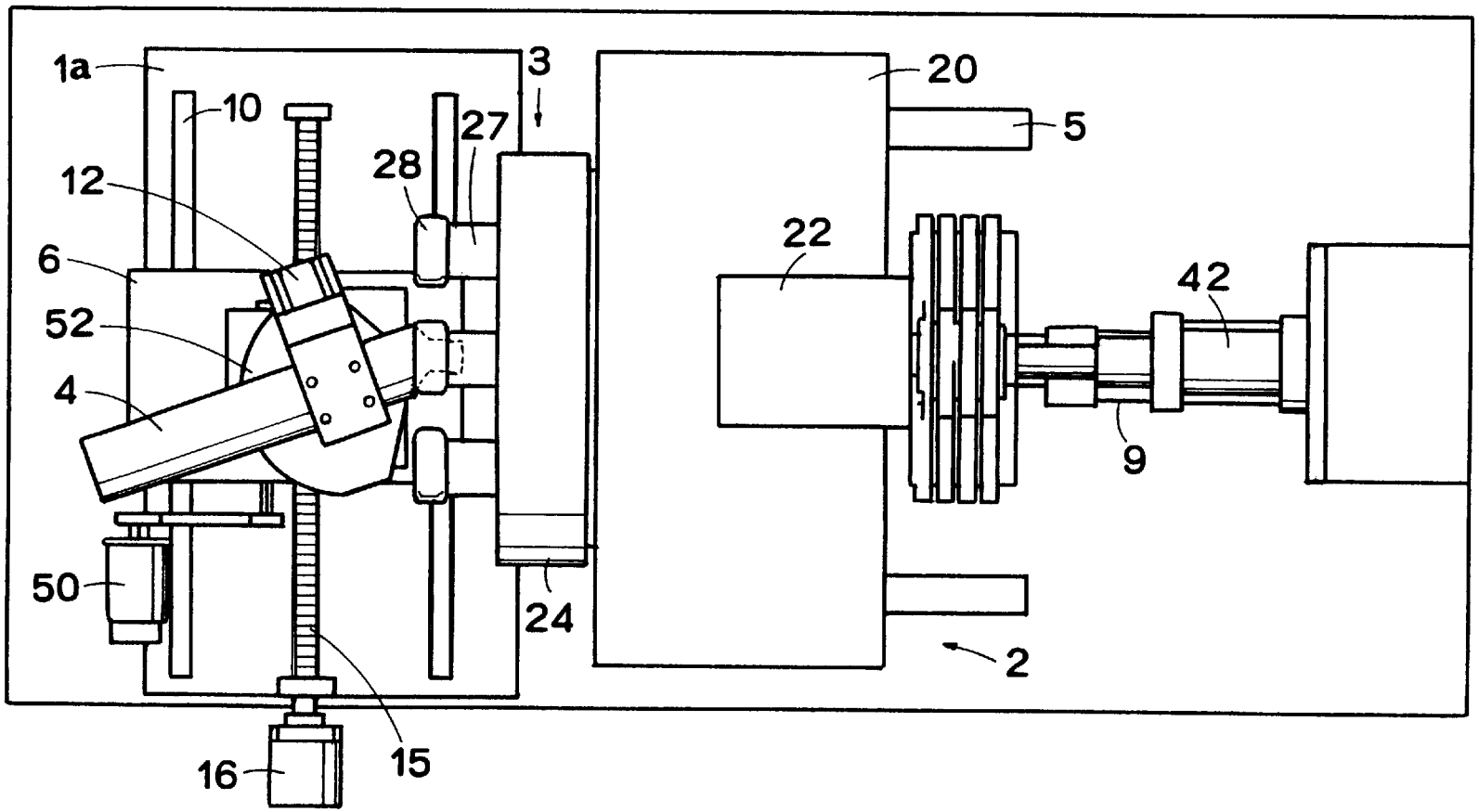
FIG. 31 is a plan view of a spinning apparatus with a portion thereof sectioned according to a further embodiment of the invention.

FIGS. 30 and 31 illustrate the spinning apparatus according to a further embodiment, wherein a mandrel 40 of a columnar configuration, with its tip end 41 configured to correspond to the inner surface of the end portion of the cylinder to be formed, is supported above the base 1 in parallel therewith. The mandrel 49 is arranged to penetrate the main shaft 21 longitudinally, and movably supported in a coaxial relationship therewith by an actuator 42 activated by oil pressure for example, which is mounted on the bracket 1*c* secured to the base 1. Instead of the motor 31 in FIGS. 2 and 3, a motor 50 and gear box 51 engaged therewith are mounted on the sliding table 6, so as to rotate a rotating table 52, on which the clamp device 12 is mounted, about a vertical axis (not shown) at the center C0 in FIG. 6. The rest of the components in FIGS. 30 and 31 have substantially the same function as those in FIGS. 2 and 3. Therefore, the components in FIGS. 30 and 31 having substantially the same function as those in FIGS. 2 and 3 are identified by the same reference numerals in FIGS. 2 and 3.

Figure 32:
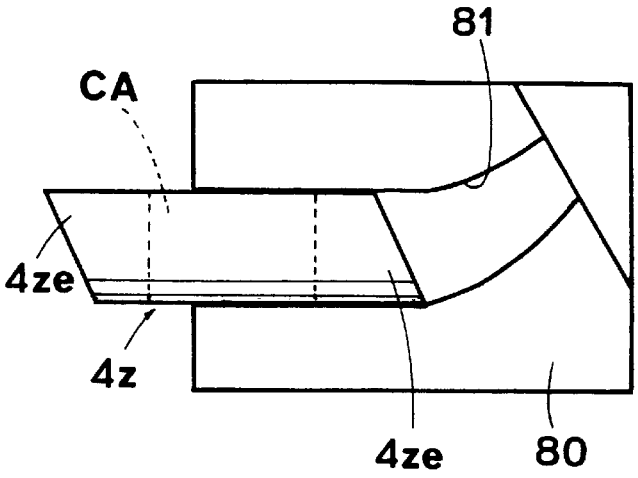
FIG. 32 is a plan view of a cylinder showing a bending process applied thereto according to a further embodiment of the invention.
Figure 33:
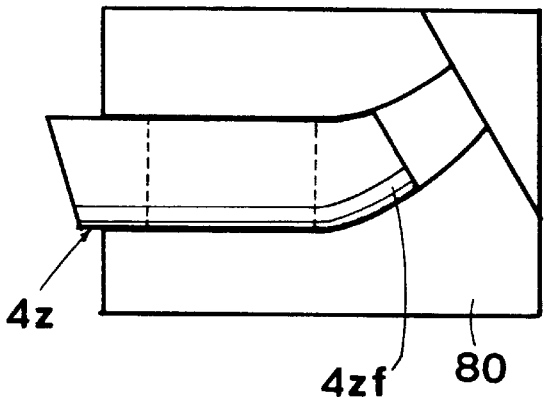
FIG. 33 is a plan view of a cylinder a showing a bending process applied thereto according to a further embodiment of the invention.
Figure 34:
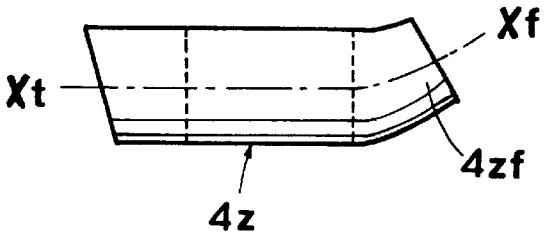
FIG. 34 is a plan view of a cylinder bent and reduced by a bending process according to a further embodiment of the invention.

Referring to FIGS. 32–37, there will be explained a further embodiment of the method for forming the end portion of the cylinder, wherein a bending device for bending the one end portion of the cylinder is used to form a bent portion at its end, in advance to the spinning process. Referring to FIG. 32, a lower die 80 and upper die (not shown) are provided to form a bore 81 having the same configuration as that of the cylinder to be bent and reduced at its end portion, as shown in FIG. 34. then, a cylinder 4*z* having slant open ends 4*ze* at its opposite ends is pushed into the bore 81 of the die 80, as shown in FIG. 33, and then removed from the die 81. Through this process, the end portion of the cylinder 4*z* is formed into a bend and reduced portion 4*zf* having a substantially oblique axis Xf inclined against the central axis Xt of the cylinder 4*z*, as shown in FIG. 34. At the same time, the slant open end 4*ze* of the cylinder 4*z* pushed into the bore 81 is formed into such an open end face of the bent and reduced portion 4*zf* that is perpendicular to the axis Xf. Thus, it will be unnecessary to cut out the open end of the cylinder 4*z* after the spinning process. As for the bending and reducing process, other processes may be employed, such as a combination of known bending process and reducing process, hydraulic forming or bulging process, high-frequency heating process, or the like. If anything is to be inserted in the cylinder 4*z*, like a catalyst CA as shown by broken lines in FIGS. 32–37, it is preferable to insert it into the cylinder 4*z* at the stage as shown in FIG. 32, or before pushing the cylinder 4*z* into the bore 81.

Figure 35:
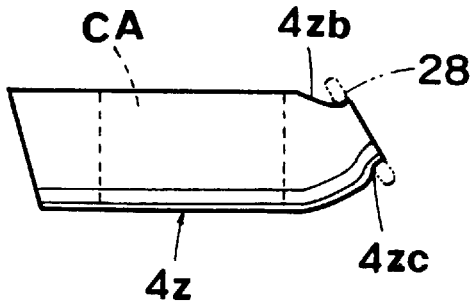
FIG. 35 is a plan view of a cylinder bent and reduced by a bending process and spinning process according to a further embodiment of the invention.
Figure 36:
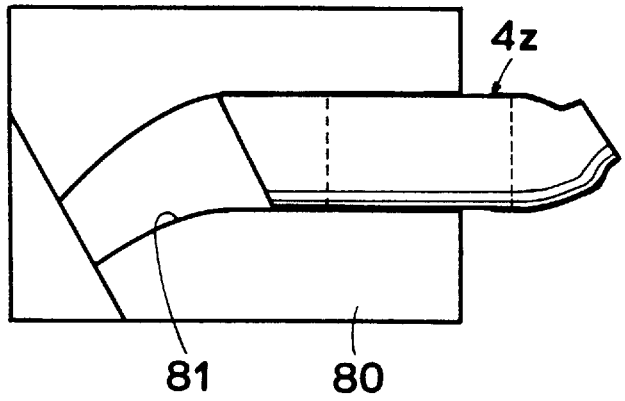
FIG. 36 is a plan view of a cylinder showing a bending process applied thereto according to a further embodiment of the invention.
Figure 37:
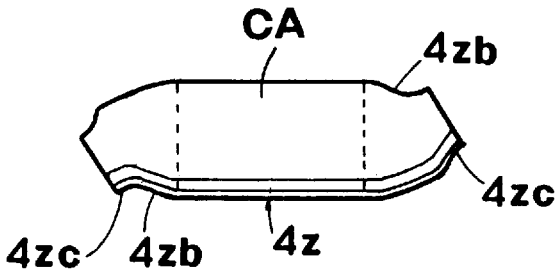
FIG. 37 is a plan view of a cylinder bent and reduced at its opposite ends by a bending process and spinning process according to a further embodiment of the invention.

Next, the cylinder 4*z* having the bent and reduced portion 4*zf* is set on the clamp device 12 of the spinning apparatus as shown in FIGS. 30 and 31. In this case, the cylinder 4*z* is positioned so as to align its axis Xf with the axis Xr of the main shaft 21. Then, by spinning the end portion 4*zf* of the cylinder 4 along the axis Xf (and, the axis Xr), the cylinder 4*z* with a tapered end portion 4*zb* and a neck portion 4*zc* having the oblique axis Xf is formed as shown in FIG. 35, with the catalyst CA held therein. The spinning process may be performed in accordance with the same manner as described with reference to FIGS. 6–17. The opposite end of the cylinder 4*z* may be formed in the same manner as shown in FIG. 36, to produce the cylinder 4*z* with the tapered end portion 4*ab* and the neck portion 4*zc* formed at its opposite ends, and the catalyst CA held therein, as shown in FIG. 37. According to the method as shown in FIGS. 32–37, therefore, it is easy to form the cylinder 4*z* provided with the tapered end portion 4*zb* and the neck portion 4*zc* having the oblique axis Xf, so that its manufacturing cost and time can be reduced, compared with the aforementioned methods.

Figure 38:
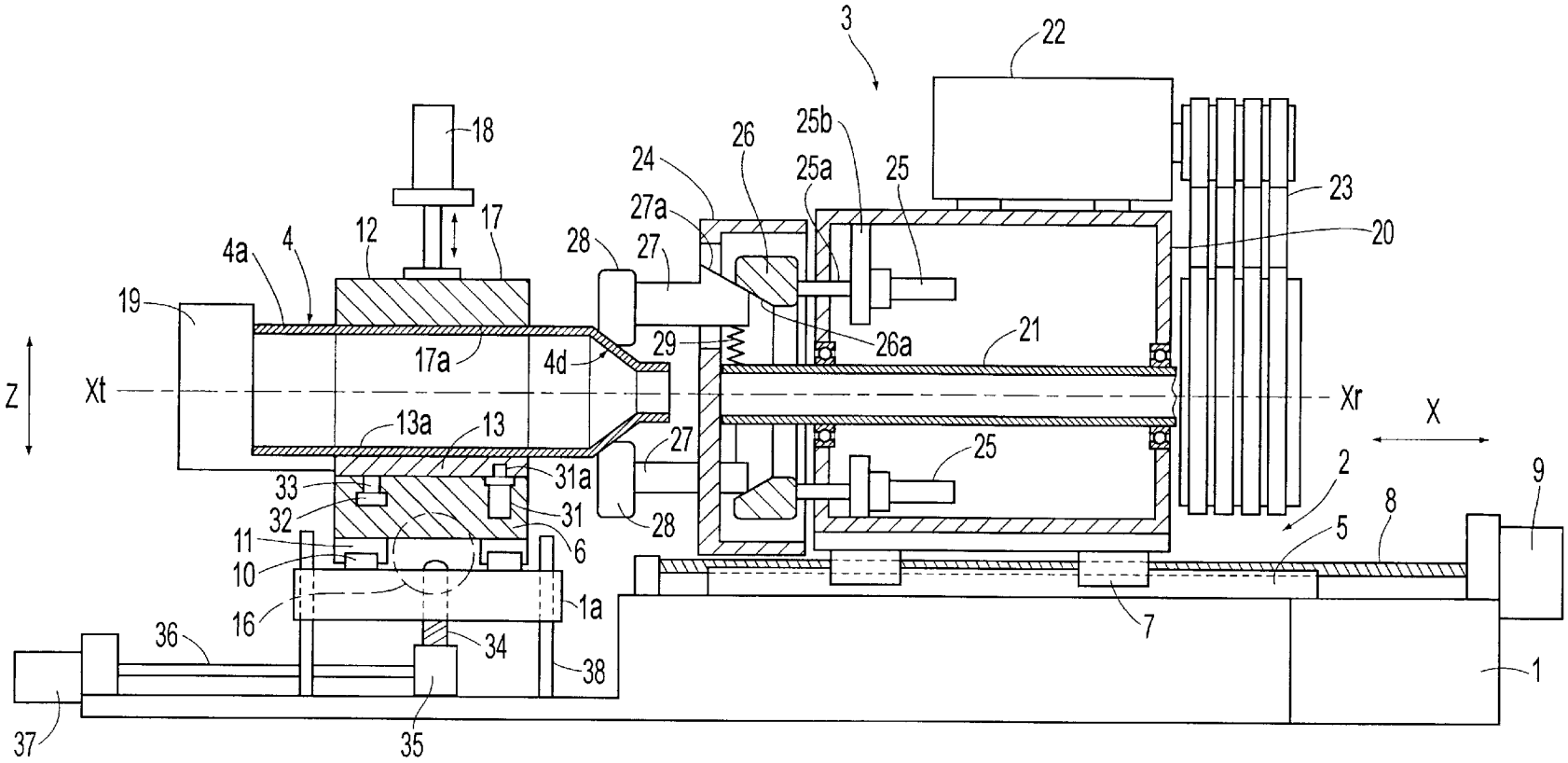
FIG. 38 is a schematic block diagram illustrating a spinning apparatus according to an embodiment of the present invention.
Figure 39:
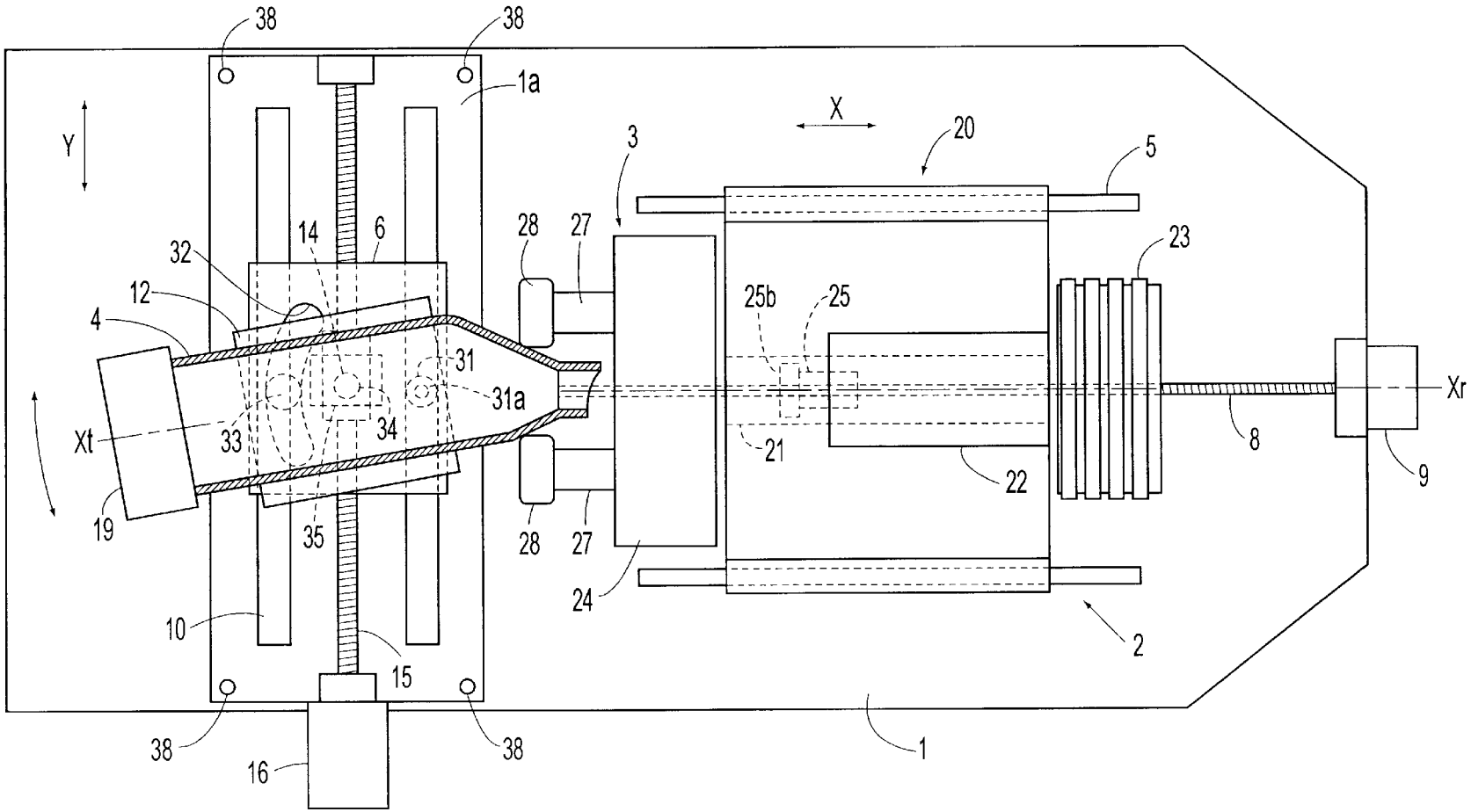
FIG. 39 is a side view of a spinning apparatus with a portion thereof sectioned according to an embodiment of the present invention.

Referring to FIGS. 38 and 39, there will be explained another exemplary embodiment according to the invention. The bed la is slidably mounted on Z-axis guide posts 38 for movement in the Z direction so that the axis Xt of the cylinder 4 can be adjusted relative to the axis Xr of the main shaft 21. The first driving mechanism 2 may also include a gear box 35 between the bed 1*a* and the base 1. The gear box 35 is engaged with a spline shaft 34 that is engaged with a hole defined in the bed 1*a*. The gear box 35 is also connected to a servo motor 37 secured to the base 1 through a connecting shaft 36. When the connecting shaft 36 is rotated by the servo motor 37, the spline shaft 34 is rotated through the gear box 35 so that the bed 1*a* is moved in the Z direction. Therefore, the axis Xt of the cylinder 4 can be adjusted to be located at a predetermined position relative to the base 1 and the axis Xt can be adjusted relative to the axis Xr of the main shaft 21. Consequently, the axis Xt of the cylinder 4 can be offset along not only the Y-axis but also along the Z-axis so that a fine adjustment can be easily made in the spinning process. Although not shown in FIGS. 38 and 39, it should be appreciated that the servo motor 37 can also be controlled by a controller CT as shown in FIG. 1 through a driving circuit.

Figure 41:
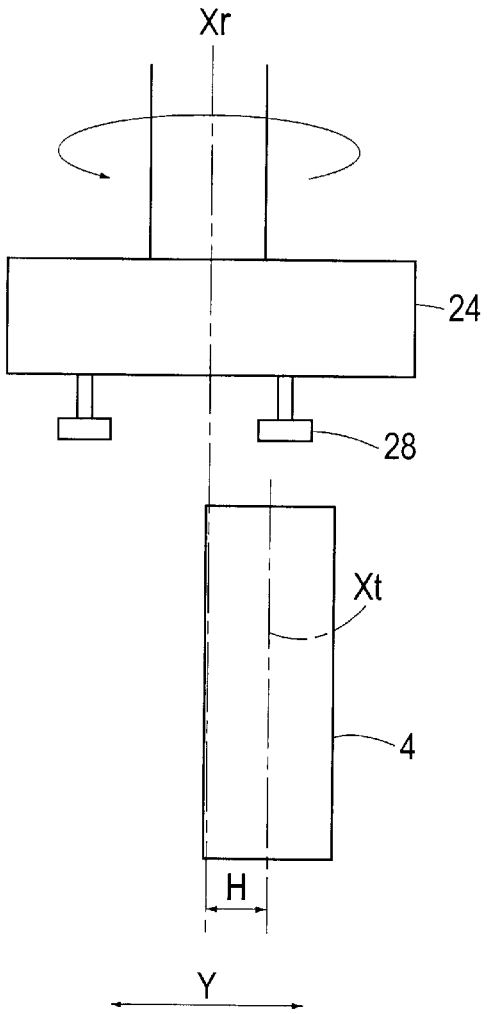
FIGS. 40 and 41 are front and top views, respectively, of a cylinder set so with a central axis of the portion to be processed offset from a forming target axis in a first direction.
Figure 40:
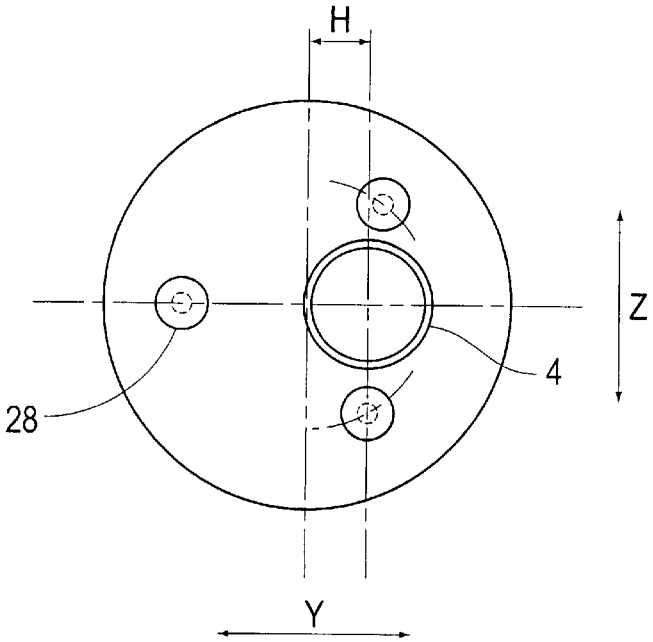
Figure 43:
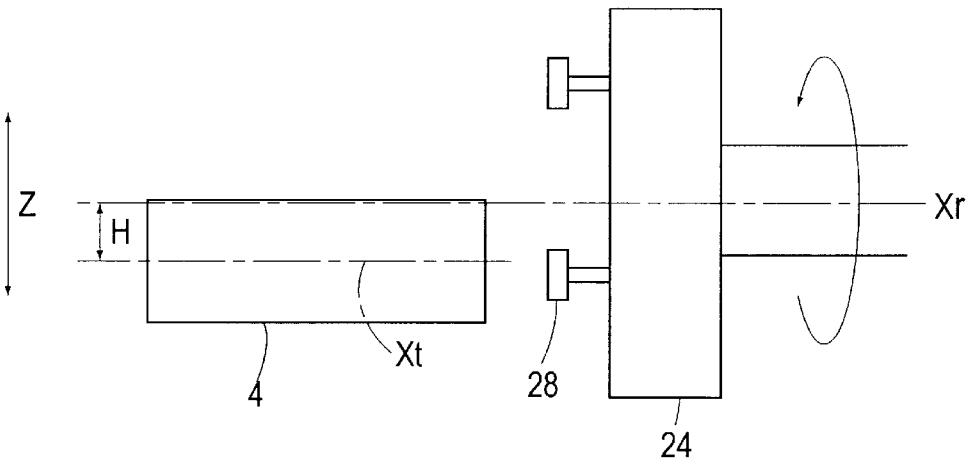
FIGS. 42 and 43 are front and side views, respectively, of a cylinder set with a central axis of the portion to be processed offset from a forming target axis in a second direction.
Figure 42:
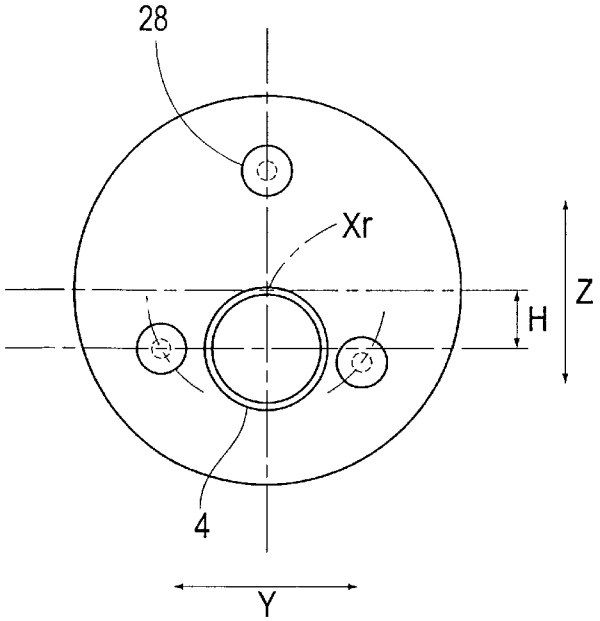

As shown in FIGS. 40 and 41, the cylinder 4 may be supported so that the axis Xt of the cylinder 4 is offset from the axis Xr of the main shaft along the Y-axis by an offset distance H. The cylinder 4 is moved along the Y-axis by moving the table 6 along the Y-axis guide rails 10 by driving the servo motor 16. The cylinder 4 may also be supported so that the axis Xt is offset from the axis Xr of the main shaft along the Z-axis by an offset distance H, as shown in FIGS. 42 and 43. The cylinder 4 is moved along the Z-axis by moving the bed la along the Z-axis guide posts 38 by driving the servo motor 37.

Although the axis Xt of the cylinder 4 has been shown in FIGS. 40–43 as offset from the axis Xr of the main shaft 21 along either the Y-axis or the Z-axis, it should be appreciated that the axis Xt of the cylinder 4 may be offset from the axis Xr of the main shaft 21 along both the Y-axis and the Z-axis and that the offset distance along each axis may be the same or different.

Figure 45:
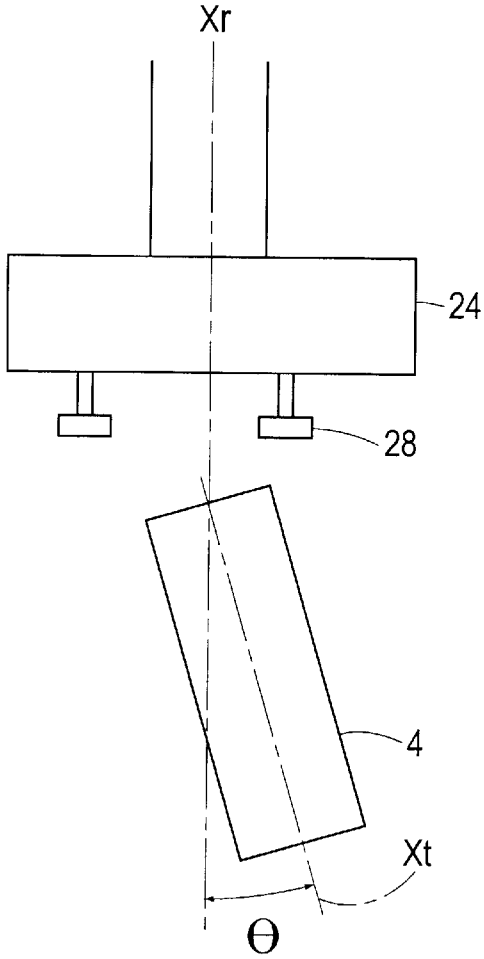
FIGS. 44 and 45 are front and top views, respectively, of a cylinder set with a central axis of the portion to be processed oblique to a forming target axis.
Figure 44:
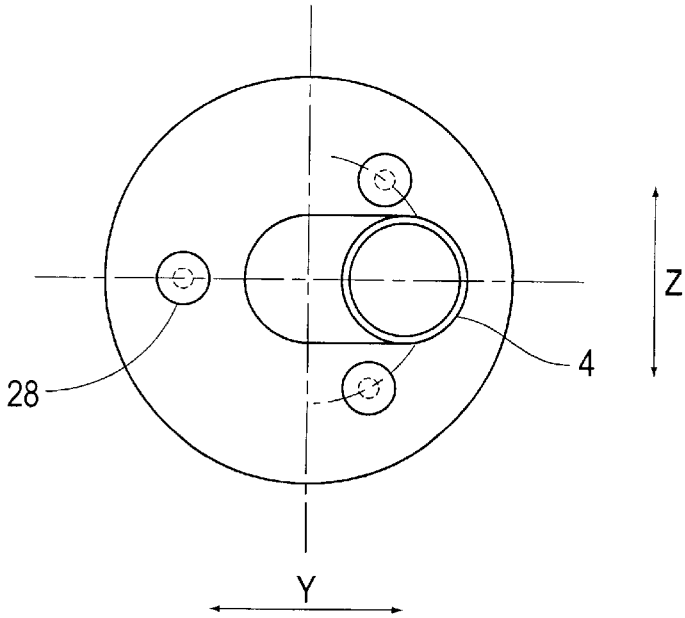

As shown in FIGS. 44 and 45, cylinder 4 may be supported so that the axis Xt of the cylinder 4 is at an oblique angle θ to the axis Xr of the main shaft 21. The axis Xt of the cylinder 4 is in the same plane as the axis Xr of the main shaft 21 and the axes Xt and Xr intersect.

Figure 47:
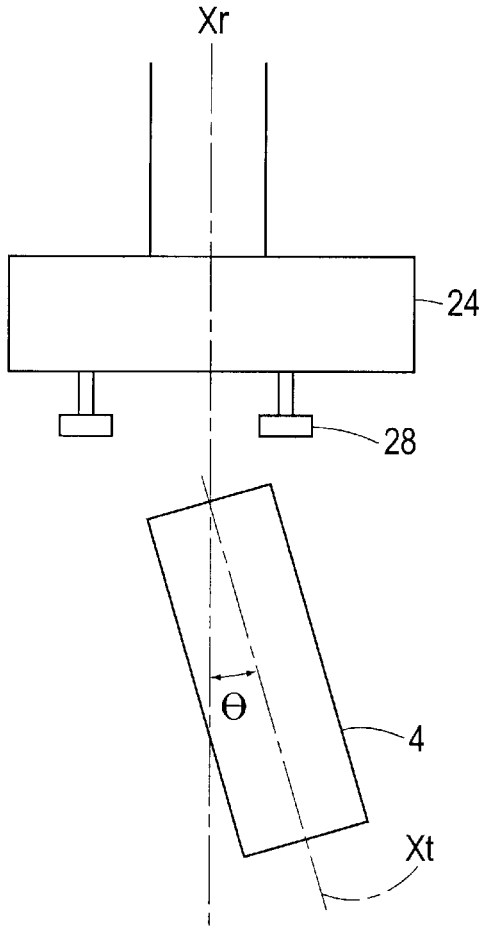
FIGS. 46 and 47 are front and top views, respectively, of a cylinder set with a central axis of the portion to be processed skewed relative to a forming target axis.
Figure 46:
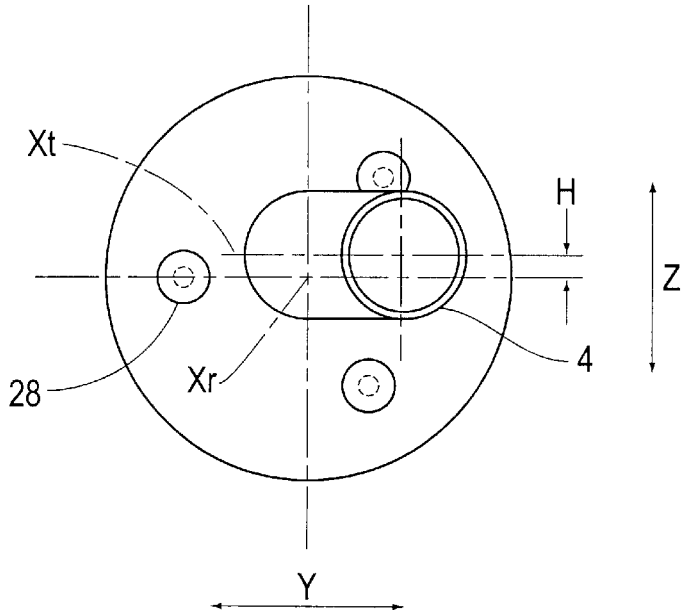

As shown in FIGS. 46 and 47, the cylinder 4 may be supported so that the axis Xt of the cylinder 4 is offset along the Z-axis from the axis Xr of the main shaft 21 by an offset distance H and is at an oblique angle 0 to the axis Xr of the main shaft 21.

As shown in FIG. 46, the axes Xt and Xr are skewed relative to another as they are not in the same plane nor do they intersect one another.

Referring to FIGS. 48A–48D, there will be explained an exemplary embodiment of a process of forming a changed diameter portion of the cylinder 4. The cylinder 4 includes two portions, an unprocessed portion UP and a processed portion PP. The length of the unprocessed portion UP and the processed portion PP are determined before processing begins. The processed portion PP may be formed so that its central axis Xpp is offset from the central axis Xt of the unprocessed portion UP of the cylinder 4, oblique to the central axis Xt of the unprocessed portion UP, or skewed to the central axis Xt of the unprocessed portion UP. A final oblique angle 0, similar to that shown in FIGS. 26 and 27, may be initially determined and a final offset distance H, similar to that shown in FIG. 23, may be determined for the processed portion PP.

Figure 48A:
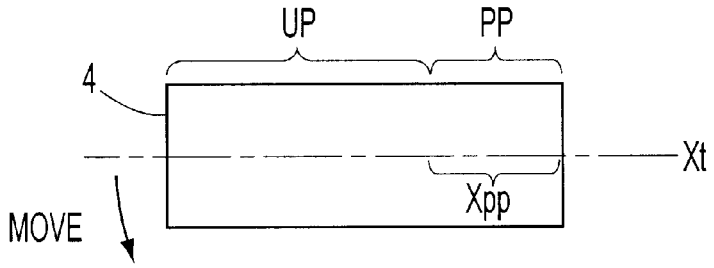
FIGS. 48A–48D illustrate a spinning process according to an exemplary embodiment of the invention.
Figure 48B:
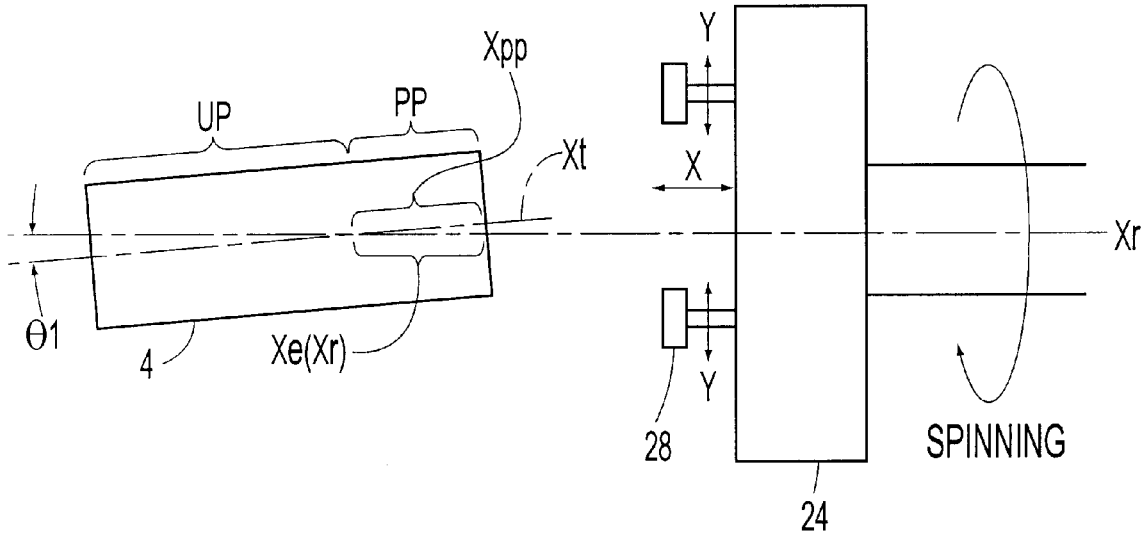

As shown in FIG. 48A, the central axis Xpp of the processed portion PP before processing begins overlaps the central axis Xt of the unprocessed portion UP of the cylinder 4. As shown in FIG. 48B, the cylinder 4 is moved by the second driving mechanism 3 and the servo motor 16, similar to the process shown in FIGS. 6 and 7, to set the central axis Xpp of the process portion PP at an initial oblique angle 01, which is less than the final oblique angle θ, relative to a forming target axis Xe that overlaps the axis Xr of the main shaft 21. The processed portion PP of the cylinder 4 is then subjected to a spinning process in which the rollers 28 rotate about the forming target axis Xe while simultaneously moving in the Y direction. The rollers 28 are moved in the X direction by the first driving mechanism 2. The rollers 28 engage the outer surface of the process portion PP of the cylinder 4 to force the central axis Xpp of the processed portion PP to match the forming target axis Xe while simultaneously reducing the diameter of the processed portion PP.

Figure 48C:
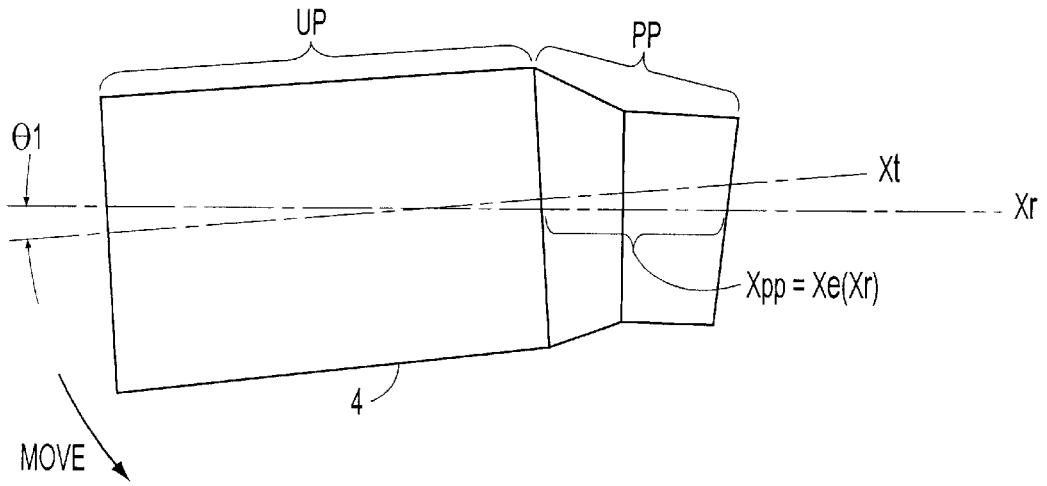
Figure 48D:
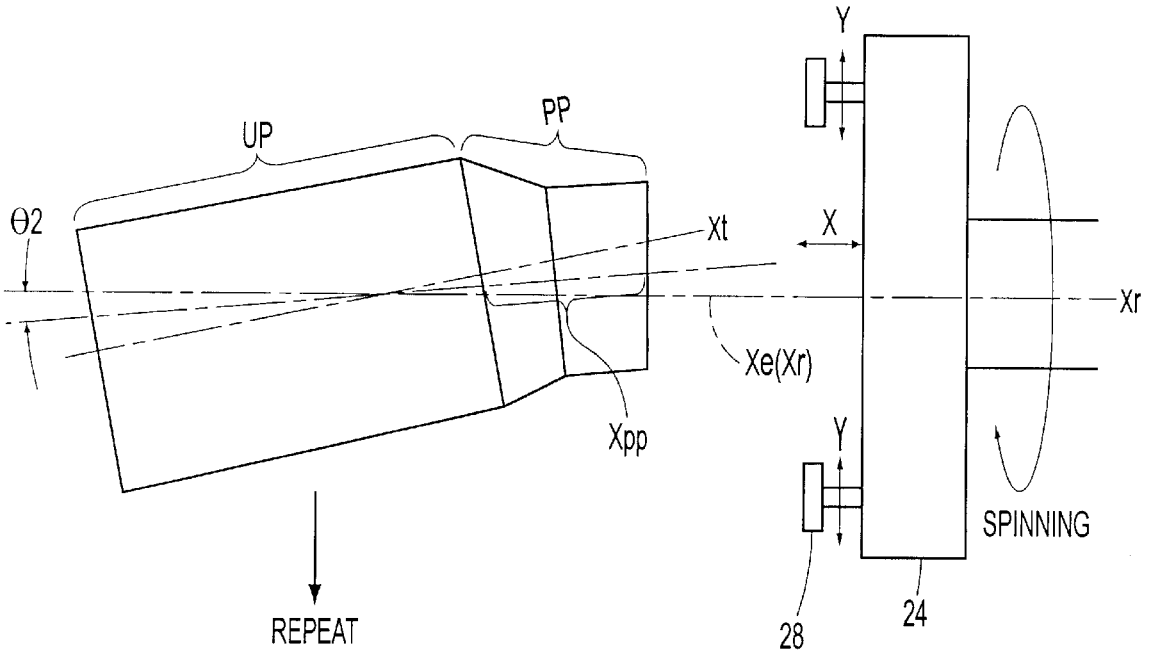

As shown in FIG. 48D, the cylinder 4 is then moved again by the first driving mechanism 2 to set the central axis Xpp of the processed portion PP at an oblique angle θ2, which is also less than the final oblique angle θ, relative to the forming target axis Xe that overlaps the axis Xr of the main shaft. The cylinder 4 is again subjected to the spinning process to force the central axis Xpp of the processed portion PP to match the forming target axis Xe while simultaneously reducing the diameter of the processed portion PP. The processes shown in FIGS. 48B–48D may be repeated until the desired oblique angle θ and the desired offset distance H of the processed portion PP are formed.

Although not shown in FIGS. 48A–48D, it should be appreciated that in addition to setting the cylinder 4 so that the central axis Xpp of the processed portion PP is initially set at an oblique angle to the forming target axis Xe, as shown in FIG. 48B, the cylinder 4 may also be set so that the central axis Xpp of the processed portion PP is offset along the Z-axis from the forming target axis Xe. The cylinder 4 would be moved along the Z-axis by the first driving mechanism 2 and set an initial offset distance from the Z-axis, as shown in FIGS. 46 and 47, so that the central axis Xpp and the forming target axis Xe are skewed relative to each other. It should also be appreciated that the cylinder 4 could be initially set so that the central axis Xpp is offset from the forming target axis Xe along either the Y-axis, as shown in FIGS. 40 and 41, or the Z-axis, as shown in FIGS. 42 and 43, or offset from both the Y-axis and Z-axis, without setting the central axis Xpp oblique to the forming target axis Xe. It should also be appreciated that the initial step of supporting the cylinder 4 shown in FIG. 48A may be omitted and the cylinder 4 may be set directly as shown in FIG. 48B. Although the processes shown in FIGS. 48B–48D are shown as being repeated, it should be appreciated that the cylinder 4 may be set in FIG. 48B at the final desired oblique angle and/or final desired offset and the process shown in FIG. 48B may be performed only once. However, the processes shown in FIGS. 48B–48D may be performed a number N of cycles and the initial oblique angle θ1 and subsequent oblique angles θ2 may be determined by dividing the final desired oblique angle θ by the number N of cycles or the oblique angles set during the terminating cycles may be made relatively short to improve the finished accuracy of the product.

Figure 49:
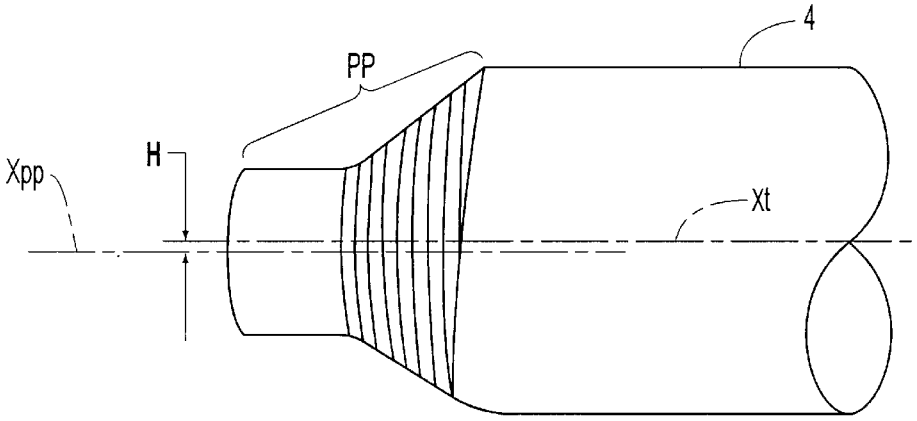
FIGS. 49–51 are top, front, and side views, respectively, of a cylinder having a changed diameter portion with a central axis skewed relative to a central axis of an unprocessed portion.
Figure 50:
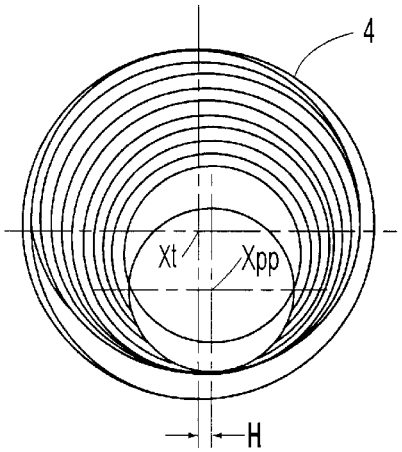
Figure 51:
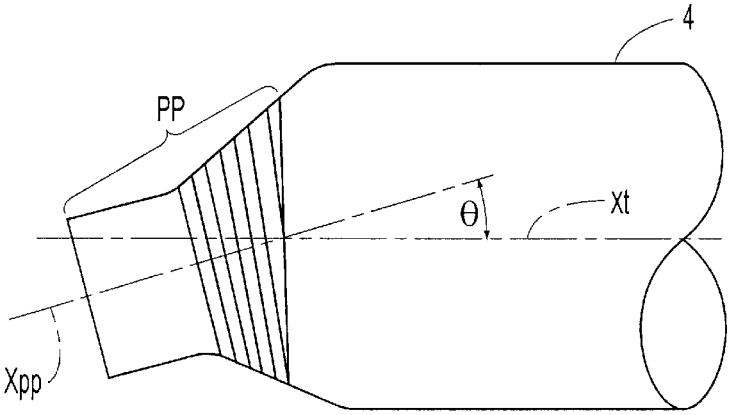

Referring to FIGS. 49–51, there is shown an example of a cylindrical member 4 having a processed portion with a central axis Xpp skewed from the central axis Xt of the unprocessed portion. The cylinder 4 is initially supported as shown in FIGS. 46 and 47 and processed according to the process shown in FIGS. 48B–48D. The central axis Xpp of the processed portion is offset from the central axis Xt of the unprocessed portion UP by a distance H and is also oblique to the central axis Xt at an angle θ.

Figure 52A:
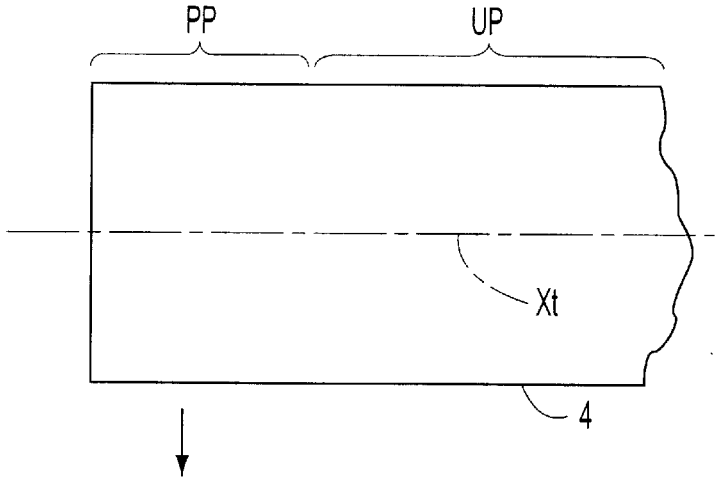
FIGS. 52A–52C illustrate a spinning process according to an exemplary embodiment of the invention.
Figure 52B:
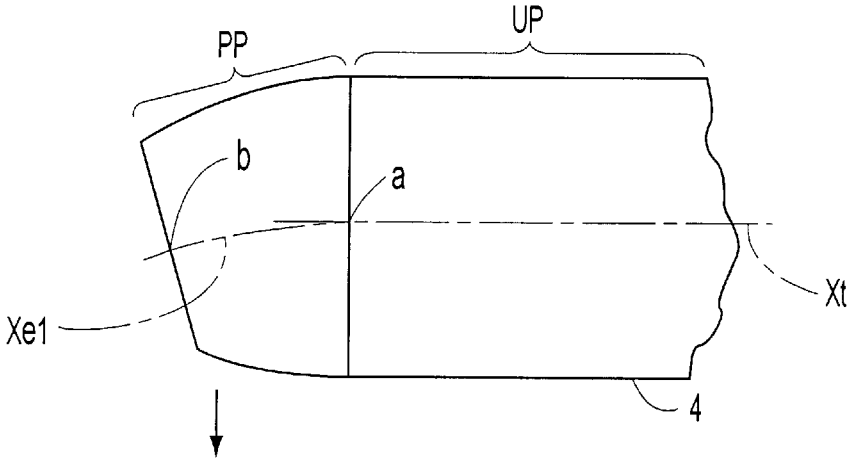
Figure 52C:
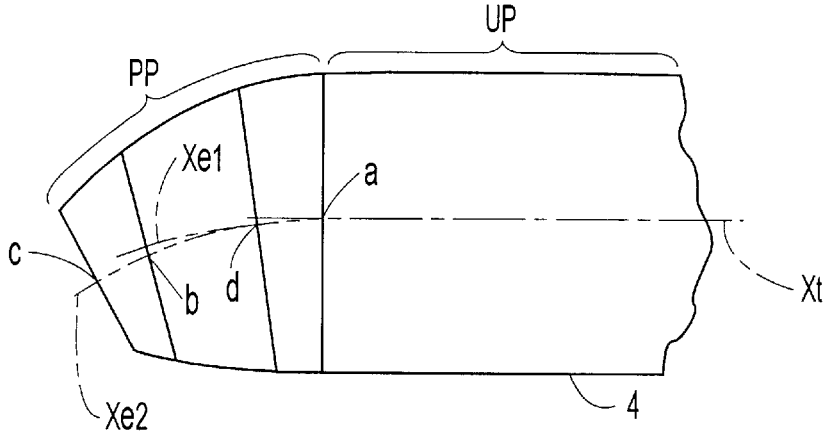

Referring to FIGS. 52A–52C, there is shown another exemplary embodiment of a process of forming a changed diameter portion of the cylinder 4. As shown in FIG. 52A, the cylinder 4 includes an unprocessed portion UP and a processed portion PP. As shown in FIG. 52B, a forming target axis Xe1 of the processed portion PP of the cylinder 4 at least partially overlaps the axis Xr and is defined by a curve containing the points "a" and "b". The intermediate forming target axis Xe may extend in three dimensions, i.e., in the along the X-axis, Y-axis, and Z-axis. The cylinder 4 is supported by the clamp device 12 as shown in FIGS. 38 and 39 and while the rollers 28 are moved along the X-axis by the first driving mechanism 2 and engaged with the outer surface of the processed portion PP of the cylinder 4, the unprocessed portion UP of the cylinder 4 in the clamp device 12 is simultaneously moved along the Y-axis by the servo motor 16 moving the table 6 along the Y-axis guide rails 10 and/or along the Z-axis by the servo motor 37 moving the bed 1*a* along the Z-axis guide posts 38 and by the motor 31 pivoting the clamp device 12 on the table 6. Moving the unprocessed portion UP of the cylinder 4 while the rollers 28 are engaged with the processed portion PP allows forming of the processed portion PP along a curved forming target axis that extends along the X-axis, Y-axis, and Z-axis so that the central axis of the processed portion PP matches the curved forming target axis while the diameter of the processed portion PP is simultaneously reduced.

As shown in FIG. 52C, the cylinder 4 may be further processed by forming the processed portion PP about another forming target axis Xe2 at least partially overlapping the axis Xr and defined by a curve containing the points "c" and "d". While the processed portion PP is engaged by the rollers 28, the unprocessed portion UP is simultaneously moved along the Y-axis and/or the Z-axis by the first driving mechanism 2 and the second driving mechanism 3 to further form the processed portion PP. It should be appreciated that the processes shown in FIGS. 52B and 52C may be repeated until the central axis of the processed portion matches a desired final curved forming target axis and the diameter is reduced to a final desired diameter. It should also be appreciated that the processed portion PP may be formed by a single spinning process with simultaneous movement of the unprocessed portion UP.

Although the forming target axes Xe1 and Xe2 are shown in FIGS. 52B and 52C as being of constant curvature, it should be appreciated that the forming target axis may have a compound curvature. As shown in FIGS. 52B and 52C, the processed portion PP having a curvilinear target forming axis produces a smooth outer shape and substantially reduces the gap between the processed portion PP and the unprocessed portion PP due to the diameter change.

Figure 53:
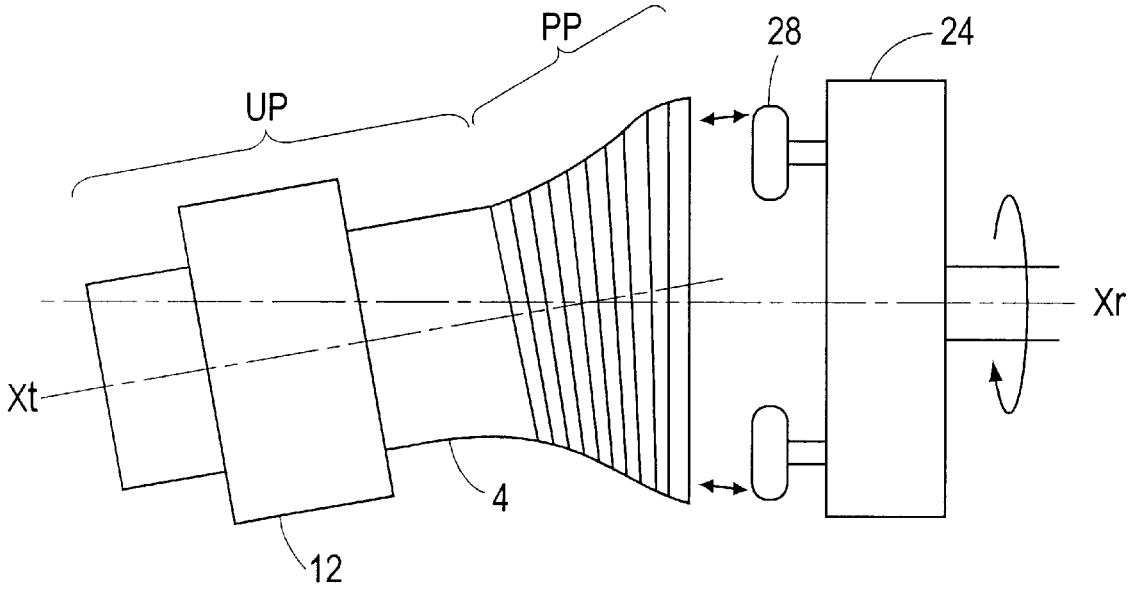
FIG. 53 illustrates a spinning process according to an exemplary embodiment of the invention.

Although the previous embodiments have been described in relation to diameter reduction processes, it should be appreciated that the diameter of the processed portion PP may be enlarged by the rollers 28 engaging an inner surface of the cylinder 4 during the spinning process as shown in FIG. 53. It should be apparent to one skilled in the art that the above-described embodiments are merely illustrative of but a few of the many possible specific embodiments of the present invention. Numerous and various other arrangements can be readily devised by those skilled in the art without departing from the spirit and scope of the invention as defined in the following claims.

What is claimed is:

1. A method of molding a portion of a workpiece to be processed so as to form a processed portion having a diameter different from an unprocessed portion of the workpiece and a central axis different from the unprocessed portion, comprising:

supporting the workpiece so that the central axis of the portion to be processed is at least one of offset from and oblique to a forming target axis;

molding the portion to be processed by a spinning process so that the central axis of the portion to be processed is forced to match the forming target axis and simultaneously changing the diameter of the portion to be processed.

2. The method of claim 1, wherein the spinning process comprises rotating the workpiece and at least one roller relative to each other about the forming target axis and moving the at least one roller radially relative to the forming target axis into contact with a surface of the portion to be processed to match the central axis of the portion to be processed to the forming target axis and to simultaneously change the diameter of the portion to be processed.

3. The method of claim 2, wherein the spinning process further comprises a plurality of cycles, each cycle beginning in a state in which the central axis of the portion to be processed is at least one of offset from and oblique to the forming target axis.

4. The method of claim 3, wherein the spinning process further comprises, at the beginning of each cycle, moving the forming target axis and the central axis of the portion to be processed relative to each other and setting the forming target axis and the central axis of the portion to be processed so that the central axis of the portion to be processed is at least one of offset from and oblique to the forming target axis.

5. The method of claim 4, wherein the spinning process further comprises moving the workpiece during contact of the at least one roller with the surface of the portion to be processed.

6. The method of claim 5, wherein the forming target axis is curvilinear.

7. The method of claim 6, wherein the forming target axis has a constant curvature.

8. The method of claim 6, wherein the forming target axis has a compound curvature.

9. The method of claim 1, wherein the forming target axis is linear.

10. The method of claim 1, wherein the workpiece is cylindrical.

11. An apparatus for processing a portion of a workpiece by spinning to form a processed portion having a diameter different from an unprocessed portion of the workpiece and a central axis different from the unprocessed portion, comprising:

a rotatable member rotatable about a main axis;

at least one roller operatively mounted on the rotatable member to be radially movable to and from the main axis, and in contact with a surface of the portion to be processed;

first driving means for moving at least one of the workpiece and the at least one roller relative to each other so that the central axis of the portion to be processed is at least one of offset from and oblique to a forming target axis that overlaps the main axis;

second driving means for moving the at least one roller radially toward the forming target axis, with the at least one roller being in substantial contact with the surface of the portion to be processed and rotating the at least one roller about the main axis relative to the workpiece; and control means for controlling the first and second driving means to form the portion to be processed into a changed diameter portion having the forming target axis.

12. The apparatus of claim 11, wherein the first driving means moves the at least one roller gradually close to the forming target axis, in accordance with a plurality of spinning cycles, and the second driving means rotates the at least one roller about the main axis relative to the workpiece every spinning cycle.

13. The apparatus of claim 11, wherein the first driving means moves at least one of the workpiece and the at least one roller relative to each other, to move said at least one roller radially toward the forming target axis, with the at least one roller being in substantial contact with the surface of the portion to be processed, and the second driving means rotates at least one of the workpiece and the at least one roller relative to each other about the forming target axis, to form the portion to be processed into the changed diameter portion having the forming target axis.

14. The apparatus of claim 13, wherein said first driving means moves at least one of the workpiece and the at least one roller relative to each other, to move the central axis of portion to be processed and the forming target axis gradually close to each other in accordance with a plurality of spinning cycles, and the second driving means rotates the at least one roller about the main axis relative to the workpiece every spinning cycle.

15. The apparatus of claim 11, wherein the second driving means includes a plurality of rollers moved radially toward the main axis, and rotated about the main axis.

16. The apparatus of claim 11, wherein the forming target axis is curvilinear and the control means controls the first driving means to move the workpiece during contact of the at least one roller with the surface of the portion to be processed.

17. The apparatus of claim 16, wherein the forming target axis has a constant curvature.

18. The apparatus of claim 16, wherein the forming target axis has a compound curvature.

19. The apparatus of claim 11, wherein the changed diameter portion is formed to provide a tapered portion, with the diameter of the workpiece gradually changed from an unprocessed portion of the workpiece.

20. The apparatus of claim 19, wherein the changed diameter portion is formed to provide the tapered portion and a neck portion of a tubular configuration extending from the tapered portion.

* * * * *